US009372002B2

(12) United States Patent
Harward et al.

(10) Patent No.: US 9,372,002 B2
(45) Date of Patent: Jun. 21, 2016

(54) HOUSEHOLD APPLIANCE HAVING AN OVEN DOOR WITH AN INTEGRAL DRIP TRAY

(75) Inventors: Samuel Harward, Knoxville, TN (US); Donald Hendricks, Caryville, TN (US); Rose Marie Parker, Caryville, TN (US)

(73) Assignee: BSH Home Appliances Corporation, Irvine, CA (US)

( * ) Notice: Subject to any disclaimer, the term of this patent is extended or adjusted under 35 U.S.C. 154(b) by 682 days.

(21) Appl. No.: 13/484,750

(22) Filed: May 31, 2012

(65) Prior Publication Data

US 2013/0319393 A1 Dec. 5, 2013

(51) Int. Cl.

| | |
|---|---|
| ***F23M 7/00*** | (2006.01) |
| ***F24C 15/04*** | (2006.01) |
| ***F24C 15/14*** | (2006.01) |

(52) U.S. Cl.

CPC ..... *F24C 15/04* (2013.01); *F24C 15/14* (2013.01)

(58) Field of Classification Search

CPC ..... F24C 15/14
USPC ..... 126/20, 190, 200
See application file for complete search history.

(56) References Cited

U.S. PATENT DOCUMENTS

| | | | | |
|---|---|---|---|---|
| 1,838,687 | A * | 12/1931 | Lawson, Sr. et al. | 132/310 |
| 3,189,020 | A * | 6/1965 | Getman | 126/190 |
| 4,253,286 | A * | 3/1981 | Katona | 52/171.1 |
| 2002/0079306 | A1 * | 6/2002 | Gros et al. | 219/396 |
| 2005/0076900 | A1 * | 4/2005 | Walther et al. | 126/198 |
| 2012/0043315 | A1 * | 2/2012 | Suenaga et al. | 219/682 |

FOREIGN PATENT DOCUMENTS

DE 10047016 A1 * 4/2002

* cited by examiner

*Primary Examiner* — Kenneth Rinehart
*Assistant Examiner* — Jason Lau
(74) *Attorney, Agent, or Firm* — James E. Howard; Andre Pallapies

(57) ABSTRACT

A household cooking appliance includes a housing having an oven chamber accessible through an opening, the opening having a seal surrounding a perimeter thereof. An oven door covering the opening and being moveable about a hinge between an open position and a closed position. The oven door includes an outer door skin having an outer glass panel, a full glass inner panel having an inner surface that abuts the seal when the oven door is in a closed position, the full glass inner panel closing an inner side of the outer door skin, and an integrated drip tray assembly that collects condensation from the full glass inner panel. The integrated drip tray assembly is sealed to the full glass inner panel.

26 Claims, 20 Drawing Sheets

HOUSEHOLD APPLIANCE HAVING AN OVEN DOOR WITH AN INTEGRAL DRIP TRAY

FIELD OF THE INVENTION

The present invention is directed to a household appliance having an oven door, and more particularly, to a household appliance having an oven door with an integral drip tray.

BACKGROUND OF THE INVENTION

Conventional ovens and ranges commonly may include an oven door with a traditional metal "plunger" on the inside surface of the door. The plunger may include a plurality of glass panels to permit viewing an interior of the over chamber. Ovens having combination convection/steam cooking features have become popular among consumers and commonly are offered by manufacturers on many oven models. Some conventional convection/steam combination ovens, or dedicated steam ovens, may have a steam cleaning process to remove or reduce food pieces or other contaminants in the oven chamber.

SUMMARY OF THE INVENTION

The present invention is directed to a household steam cooking appliance including a housing having an oven chamber accessible through an opening, the opening having a seal surrounding a perimeter of the opening, and an oven door covering the opening and moveable about a hinge between an open position and a closed position, the oven door including an outer door skin having an outer glass panel, a full glass inner panel having an inner surface that abuts the seal when the oven door is in a closed position, the full glass inner panel closing an inner side of the outer door skin, and an integrated drip tray assembly that collects condensation from the full glass inner panel, the integrated drip tray assembly being sealed to the full glass inner panel.

In this way, the present invention can provide a door for a steam oven having a full inner glass panel that can collect condensation that may run down the full glass inner door panel when the door is opened, that can moveably and flexibly support the full glass inner door panel in a "floating" position such that the full glass inner door panel can absorb shocks or impacts on the glass to comply with ratings agencies and industry/government standards. The present invention can provide a door for a steam oven that is easy to wipe and clean, increases an amount of space in the cooking chamber, reduces a number of glass panels needed to provide a suitable surface temperature of the door skin, and provides an aesthetically pleasing appearance that can match full inner glass panel doors of other cooking chambers for marketing purposes.

To provide a better understanding of the invention, a summary of the problems with the conventional designs recognized by the present invention along with the reasons for improving the arrangement of the conventional steam oven door and the corresponding advantages provided by the present invention will be explained in greater detail.

Some conventional appliances may include a conventional oven door in which the inside surface comprises a solid sheet of glass instead of a traditional metal "plunger". The implementation of such glass inner surfaces primarily has been driven by marketing objectives and commonly for cosmetic purposes. Such glass inner surfaces also can provide practical advantages such as making wiping and cleaning of the inside surface of an oven door easier and simpler for a user. Many conventional cooking appliances may include a plurality of oven chambers, such as a conventional oven, convection oven, steam oven, etc. In this case, marketing objectives may require that all of the oven doors have a similar external appearance when the doors are closed, as well as a similar internal appearance when the doors are open.

The present invention recognizes that many conventional steam oven doors have differences in function, appearance, and dimensional constraints associated with the operation of the steam oven, compared to conventional baking or convection oven doors with a full glass inner panel. Moreover, by replacing the conventional plunger with a full glass inner panel, the structural components of the steam oven door generally cannot be coupled to the full glass inner panel, and instead, can be coupled to the door skin. Furthermore, the present invention recognizes that the full glass inner surface may be more susceptible to breakage or fracturing as a result of dropping items on the full glass inner panel.

The present invention addresses these problems by providing a steam oven door having a full glass inner surface that may match a main oven cavity door having a full glass inner surface, thereby maintaining a common cosmetic appearance with the other full-surface-glass-interior doors of a range.

The present invention can provide a steam oven door (such as a door for a convection/steam combination oven) having an integral drip tray to collect condensation that may run down the full glass inner door panel when the door is opened. The present invention can include a drip tray sealed to a lower edge of the full glass inner panel that moves with the door to catch most or all condensation, while at the same time providing a subtle, unobtrusive appearance. The integral drip tray can include an integral drip guard that can cooperate with a surface of the full glass inner panel to form a reservoir that collects condensation from the full glass inner panel such that the condensation can be prevented from running uncontrollably off of the full glass inner panel and can be collected and stored in the reservoir until the condensation evaporates. The integral drip tray can include a watertight sealing surface with the full glass inner panel.

The present invention can support the full glass inner panel, which is formed from a transparent ceramic material with a low coefficient of thermal expansion, with a shock absorbing fixation or support means for distributing forces exerted on the glass to prevent breakage and comply with ratings agencies and industry/government standards. For example, the shock-absorbing means for absorbing and distributing shocks and impacts on the full glass inner panel can include a support plate having a rope gasket resiliently and movably supporting the full glass inner panel. The support plate can be coupled to a top surface of the outer door skin and a bottom surface of the outer door skin. The support plate can include a first opening for viewing through the support plate, with the rope gasket extending around a perimeter of the first opening. The support plate includes a plurality of second openings disposed around the perimeter of the first opening, with the rope gasket engaging each of the plurality of second openings.

In this way, the exemplary embodiments can provide a steam oven door for a steam oven having a full glass inner panel that is capable of collecting condensation that may run down the full glass inner door panel when the door is opened, while also supporting the full glass inner panel in a moveable and flexible "floating" position such that the full glass inner door panel can absorb shocks or impacts on the glass to comply with ratings agencies and industry/government standards. The exemplary embodiments can provide an internal support plate having a rope gasket for resiliently and movably supporting the full glass inner panel. In this way, the internal metal support or plate can take the place of a conventional window pack having three or more panes of glass.

For purposes of this disclosure, the term "float" means that the full transparent ceramic inner glass is configured to move by one or more predetermined distances in one or more directions with respect to the door, such as a side-to-side direction with respect to the door, a top-to-bottom direction with respect to the door, and a front-to-back direction with respect to the door (i.e., approximately normal to a planar surface of the glass) or a combination thereof.

For purposes of this disclosure, the term "inner glass" is defined as the glass panel of the door that is disposed on an inner side of the door that is closest to an opening of the oven chamber. The term "outer glass" is defined as the cosmetic glass panel of the door skin that is furthest from the opening of the oven chamber.

The present invention can provide means for coupling the full glass inner panel to the outer door skin and avoiding any penetrations through the full glass inner panel while minimizing or eliminating cosmetic blemishes on the exterior of the door skin. For example, the outer door skin can include a retaining lip extending across a top edge of the outer door skin, the retaining lip retaining a top edge of the full glass inner panel. The integral drip tray can include integral hinge covers formed with the integral drip guard to support the full glass panel, for example, along the bottom edge and side edges. The integral hinge covers also can be configured to couple the full inner glass panel to the door skin while minimizing or eliminating cosmetic blemishes on the exterior of the door skin.

Moreover, the exemplary embodiments can provide one or more self-locating features for easily and quickly locating a correct position of the drip tray assembly with respect to the full glass inner panel.

The outer door skin can include a hinge retainer configured to couple a hinge assembly, such as a soft close hinge assembly, of the steam oven door to the outer door skin while minimizing or eliminating cosmetic blemishes on the exterior of the door skin.

The steam oven door further can include an outer glass panel mounting system that can couple the outer glass panel to the outer door skin. The outer glass panel mounting system can include, for example, a plurality of studs coupled to the outer door skin, and a plurality of brackets engaging the plurality of studs and supporting the outer glass panel between the plurality of brackets and the outer door skin. According to the exemplary embodiments, an outer glass panel mounting system can minimize or eliminate cosmetic blemishes on the exterior of the door skin, while providing a tight, gap-free fit of outer glass panel to door skin that remains securely attached to the door skin through a full operating temperature range of the appliance. The outer glass panel mounting system also can provide the ability to remove the outer glass panel for service without breaking/reapplying adhesive.

Moreover, according to the present invention, an embodiment may control a temperature on the exterior of the steam oven door to be within acceptable limits such that a predetermined safe temperature can be maintained on the exterior surfaces of the door (e.g., door skin, outer glass, etc.), even at high temperatures associated with a process.

Other features and advantages of the present invention will become apparent to those skilled in the art upon review of the following detailed description and drawings.

BRIEF DESCRIPTION OF THE DRAWINGS

These and other aspects and features of embodiments of the present invention will be better understood after a reading of the following detailed description, together with the attached drawings, wherein.

DETAILED DESCRIPTION OF THE EXEMPLARY EMBODIMENTS OF THE INVENTION

Figure 1A:
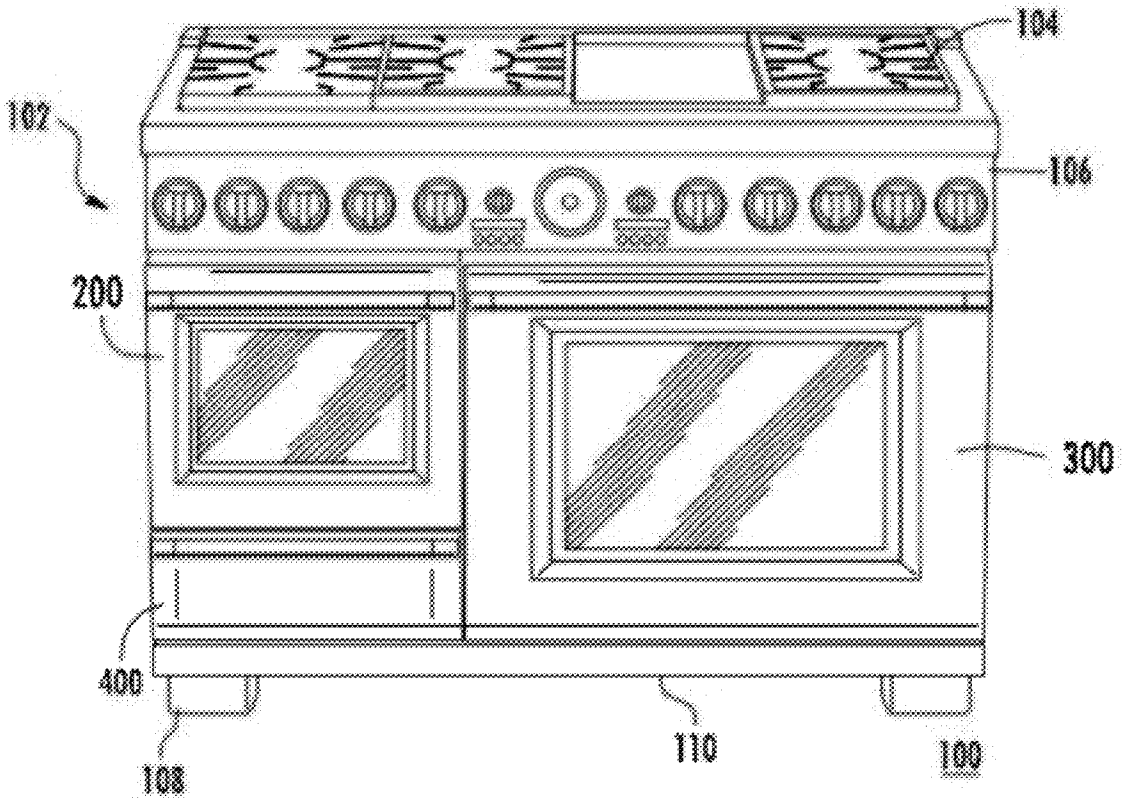
FIGS. 1A-1C are a front view, a side view, and a perspective view, respectively, of a household appliance according to an exemplary embodiment of the invention.

The present invention now is described more fully hereinafter with reference to the accompanying drawings, in which embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

Referring now to the drawings, FIGS. 1A-15B illustrate exemplary embodiments of a household appliance having a steam oven door with a full glass inner surface and an integral drip guard. Prior to describing the exemplary embodiments of a steam oven door with a full glass inner surface and an integral drip guard in greater detail, and to provide a better understanding of the invention, this disclosure will first describe examples of a household appliance and an exemplary steam oven door of a household appliance. Other features and components of the oven door, including examples of an inner glass suspension system and outer glass mounting system, also will be described following the description of the full glass inner surface and integral drip guard to provide a better understanding of the overall arrangement and features of the exemplary steam oven door. To provide a better understanding of the invention, the description will start with the components of an innermost side of the steam oven door and progress toward the front door skin of the door.

Figure 1B:
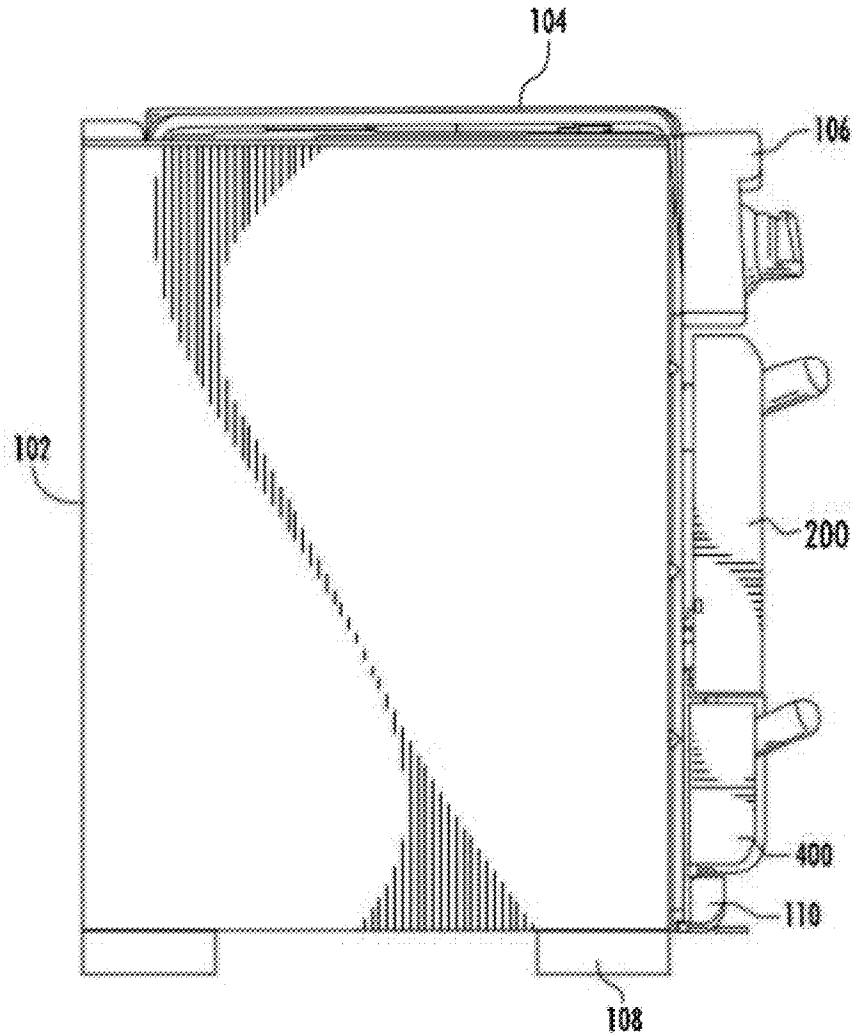
Figure 1C:
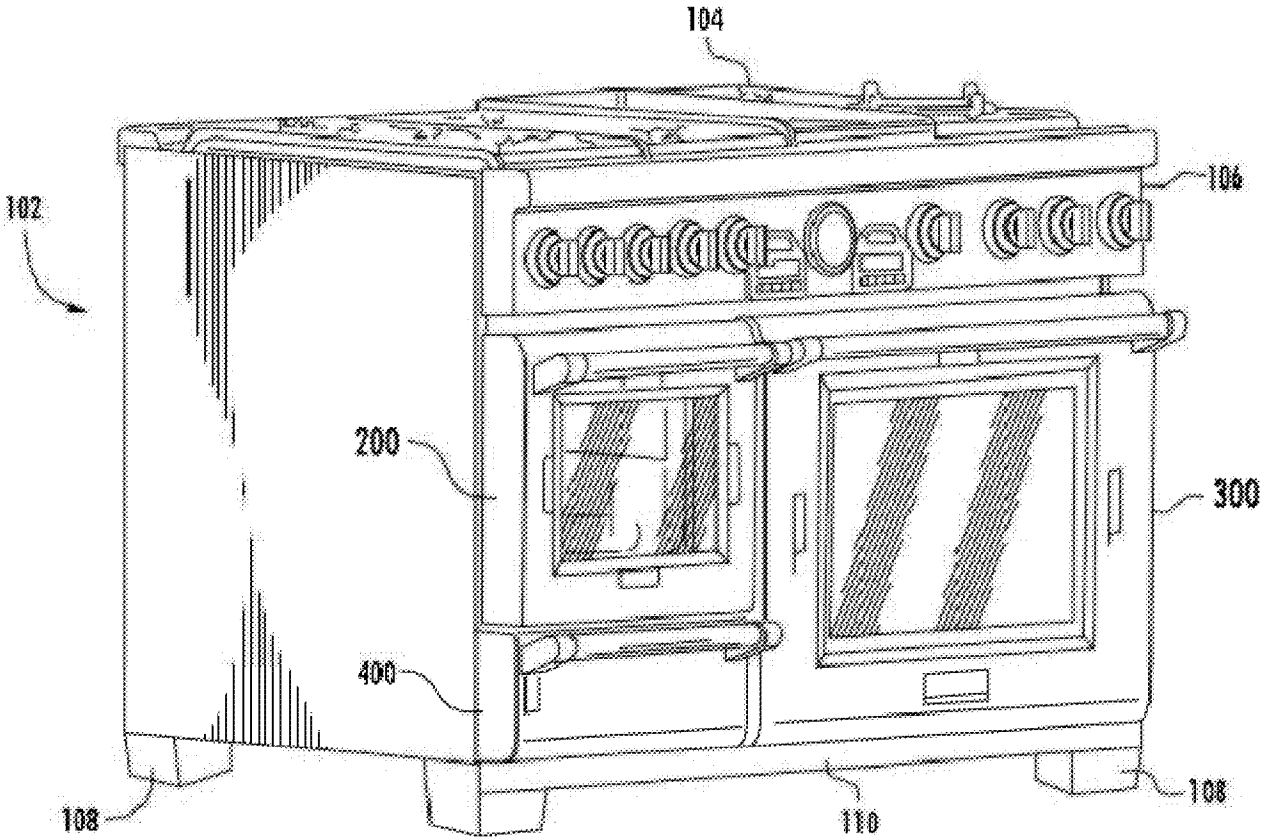

With reference to FIGS. 1A-1C, a household cooking appliance can include, for example, a gas cooking range 100 having a housing 102 including one or more cooking or warming devices, such as a cooktop, gas oven, electric oven, steam oven, convection oven, and/or warming drawer. In other embodiments, the appliance 100 can include one or more oven cooking chambers without a cooktop. In other embodiments, the appliance 100 can include a standalone appliance, wall mounted appliance, such as a stand-alone oven or wall mounted oven. For example, the appliance housing 102 can include a cooktop 104 and control panel 106. The cooktop 104 can include, for example, a gas cooktop having a plurality of gas burners, or other types of cooktops, such as an electric cooktop, an induction cooktop, or the like. The exemplary household appliance 100 can include one or more doors, such as a steam oven door 200, a baking oven door 300, and/or a warming drawer door 400 for providing access to one or more chambers of the housing 102. The housing 102 can include pedestal feet 108 for example for supporting the stand alone appliance and a kick panel 110.

Figure 2:
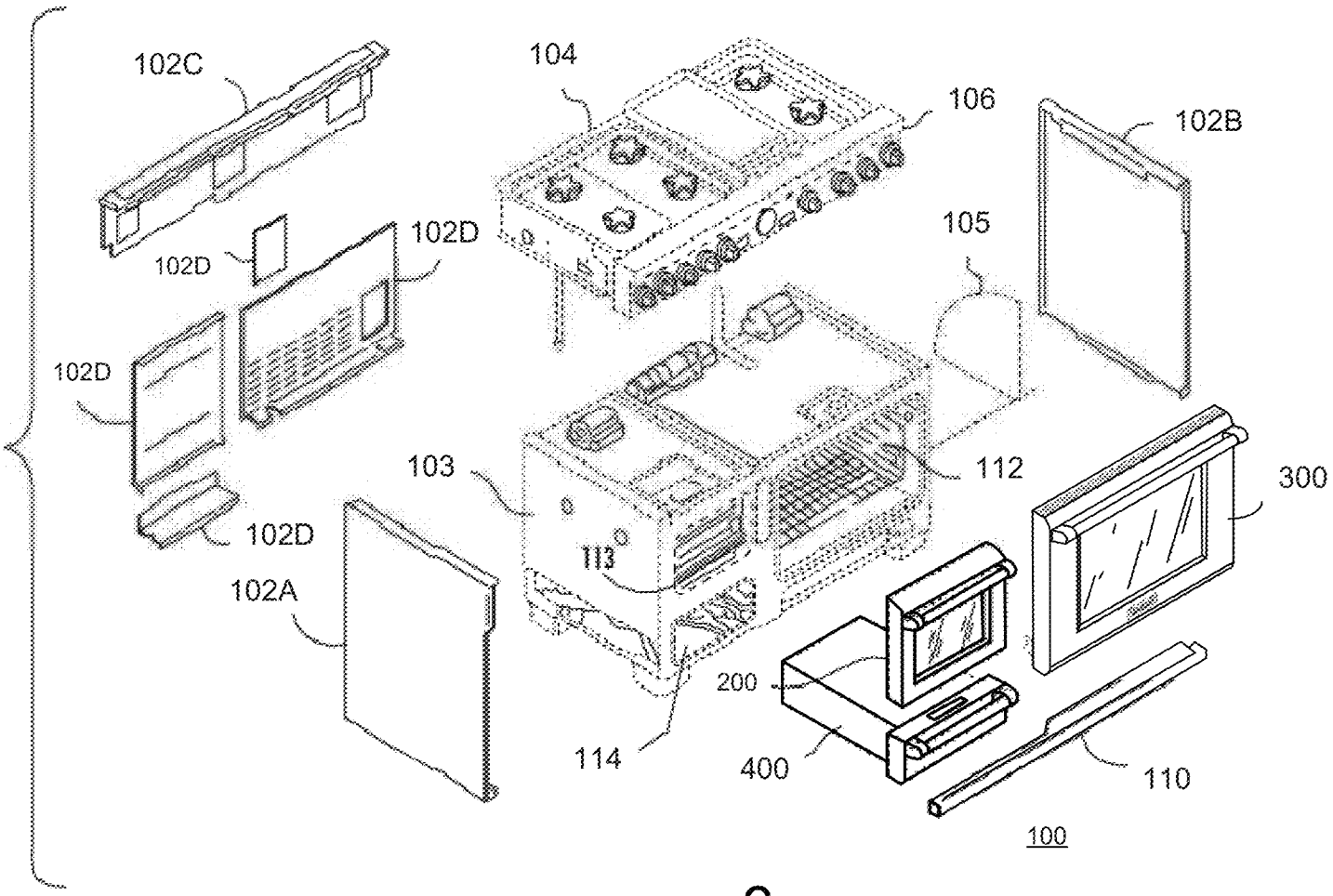
FIG. 2 is an exploded view of the exemplary household appliance of FIGS. 1A-1C.

Referring to FIG. 2, an exploded view of the appliance 100 of FIGS. 1A-1C includes housing parts 102A, 102B, 102C, 102D, the cooktop 104, and control panel 106, a steam oven door 200, a baking oven door 300, and a warming drawer door 400, and kick panel 110. For example, the housing of the exemplary household appliance 100 shown in FIG. 2 can include left-hand and right-hand sidewalls 102A, 102B and one or more rear panels 102D on a frame 103. The exemplary appliance 100 can include other devices and features, such as, for example, a backsplash or venting device 102C, hideaway label plate 105, etc. The frame 103 can include one or more chambers for cooking or warming devices, such as a baking oven chamber 112, steam oven chamber 113, and/or warming drawer chamber 114, each covered by the baking oven door 300, steam oven door 200, and warming drawer door 400, respectively.

Figure 4:
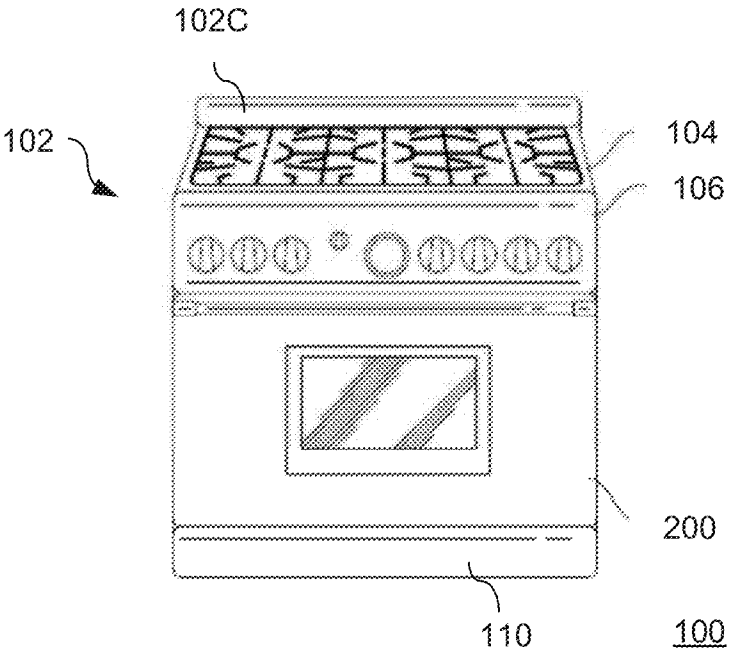
FIG. 4 is a front perspective view of a household appliance according to another exemplary embodiment of the invention.
Figure 3:
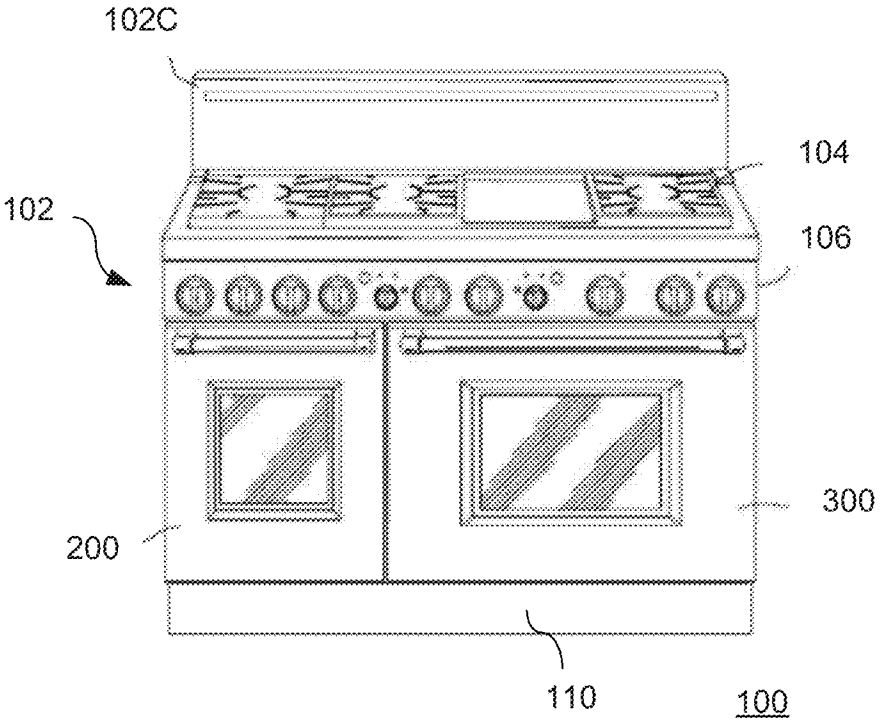
FIG. 3 is a front perspective view of a household appliance according to another exemplary embodiment of the invention.

The exemplary embodiments are not limited to the oven 100 of FIGS. 1A-1C having the baking oven door 300, steam oven door 200, and warming drawer door 400, and can be applied to other appliances, such as the appliance 100 illustrated in FIGS. 3 and 4. Like reference numerals are used to identify the features of the embodiments of the appliance 100 in FIGS. 1A-4. The features shown in FIGS. 3 and 4 are similar to, or the same as, the features of FIGS. 1A-1C, and therefore, are not repeated.

Figure 5:
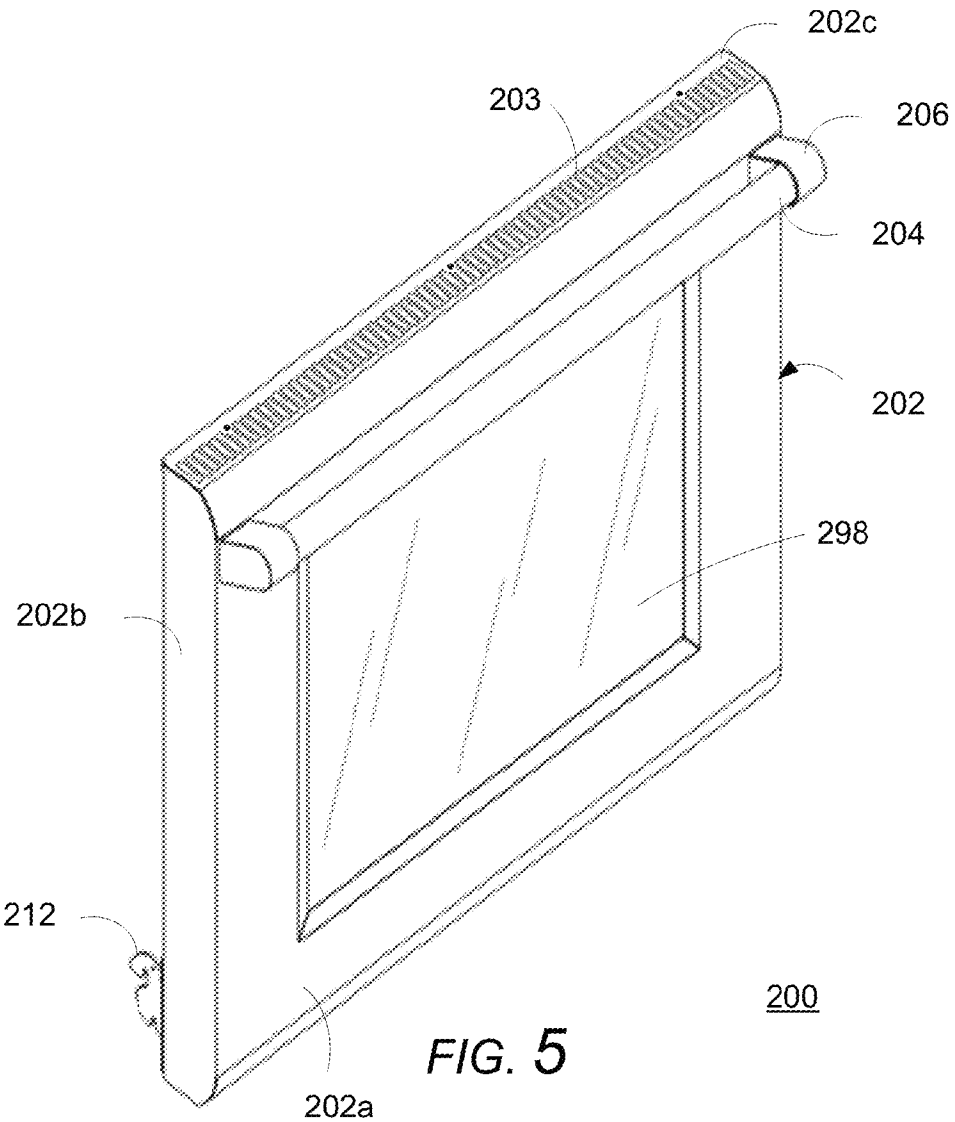
FIG. 5 is a front perspective view of a steam oven door according to an exemplary embodiment of the invention.

With reference to FIG. 5, an exemplary embodiment of a steam oven door 200 (as illustrated in the examples of FIGS. 1A-4) will now be described.

The steam oven door 200 can include a door skin 202 having a front surface 202*a* that faces away from the oven chamber, side surfaces 202*b*, a lower surface (not shown), and a top surface 202*c*. The top surface 202*c* can include a plurality of vents 203 for permitting air flow through the door. The door skin glass may be provided with or without a heat reflective coating. The door 200 can include a handle 204 supported from the door skin 202 by handle mounts 206. The door 200 can include an outer glass panel 298 and an inner glass panel (e.g., full inner glass panel; not shown in FIG. 5) for viewing an interior of the oven chamber through the door 200 while keeping a temperature of the outer glass panel 298 at an acceptable temperature. The door 200 can include hinge claws 212 to facilitate pivoting of the door 200 with respect to the appliance housing for opening and closing the oven chamber.

Figure 6A:
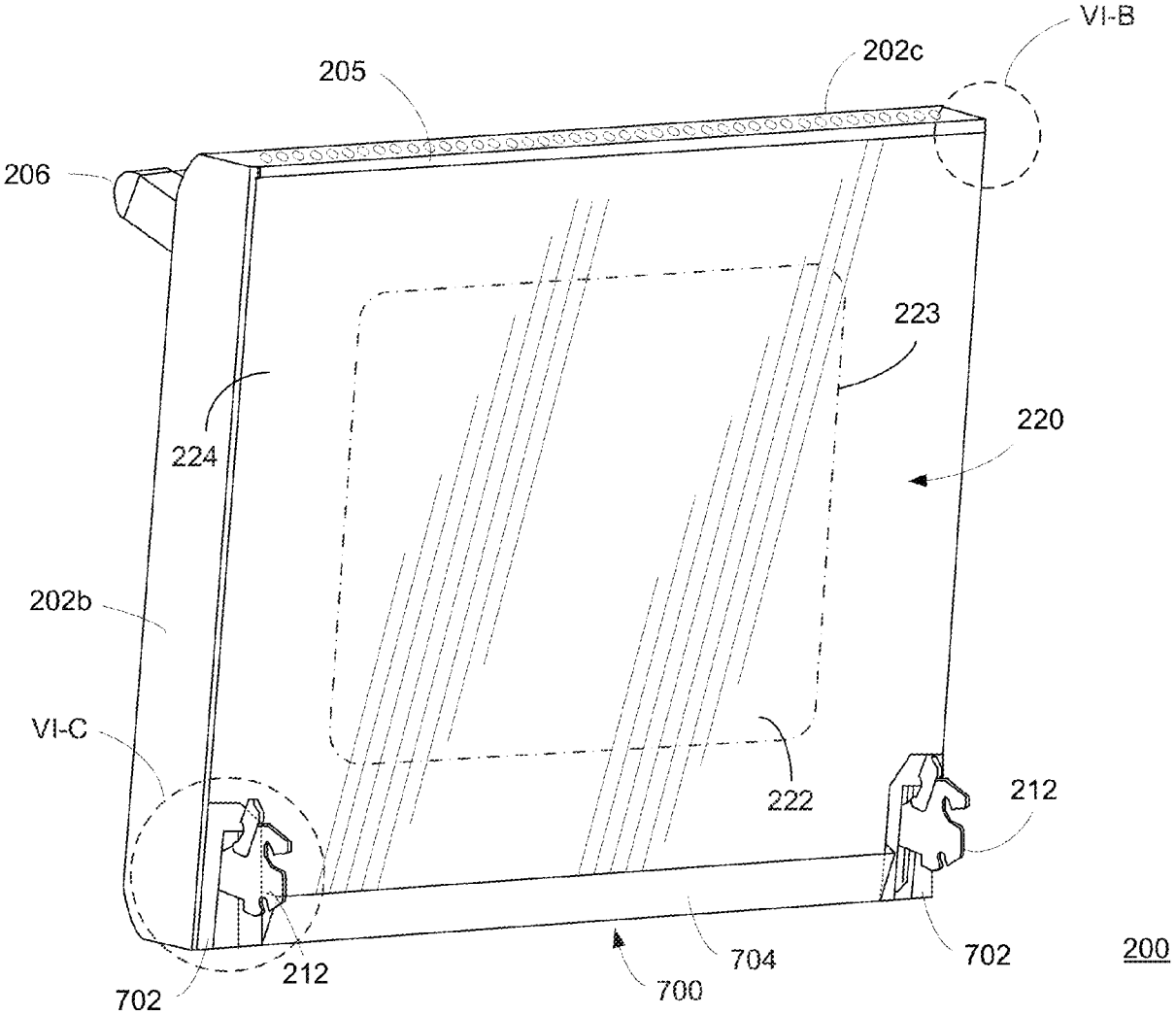
FIGS. 6A-6D are a rear perspective view of a steam oven door, a partial perspective view of a retaining lip of the steam oven door taken at VI-B of FIG. 6A, a partial perspective side view of a hinge cover and a drip guard of the steam oven door taken at VI-C of FIG. 6A, and a partial perspective bottom view of a hinge cover and a drip guard of the steam oven door taken at VI-C of FIG. 6A, respectively, according to an exemplary embodiment of the invention.

With reference to FIG. 6A, an exemplary embodiment of the door 200 of FIG. 5 can include a full glass panel formed by a transparent ceramic inner panel 220 (e.g., a full glass ceramic inner panel, which is shown in greater detail in FIG. 7). The door 200 can include a lip 205 extending for example along an inner edge of the top surface 202*c*. The lip 205 can be integrally formed with the top surface 202*c* or formed as a separate component coupled to the top surface 202*c*. As shown in FIG. 6A, the door 200 can include a drip tray assembly 700 coupled to and sealed with respect to the transparent ceramic inner panel 220 for collecting condensation from the transparent ceramic inner panel 220. The drip tray assembly 700 can include integral hinge covers 702 that are adjacent to or surround the hinge claws 212, which facilitate pivoting of the door 200 with respect to the appliance housing for opening and closing the oven chamber. The hinge cover 702 can include an opening for accommodating the hinge assembly (240 in FIG. 8) and also covering portions of the hinge assembly (240 in FIG. 8) within the door 200 from view. The drip tray assembly 700 can include an integral drip guard 704 that extends along a bottom edge of the transparent ceramic inner panel 220 for collecting condensation from the transparent ceramic inner panel 220. The integral drip guard 704 can form a reservoir for collecting condensation as explained in greater detail with respect to FIGS. 7A-7C. The drip tray assembly 700 can be formed, for example, from metal such as stainless steel. The hinge cover 702 also can be part of a system that retains the ceramic transparent panel 220 in the door 200 by restraining the panel 200 at the bottom of the door 200 while at the same time covering the hinge assembly (240 in FIG. 8), as described in more detail with reference to FIGS. 6B-6D.

With reference again to FIG. 6A, an example of a transparent ceramic inner panel 220 includes a first inner portion 222 that is disposed adjacent to an area within a gasket (not shown) surrounding the opening of the steam oven chamber opening (e.g., 113 in FIG. 2) and sealing the door 200 to the opening. The area of the transparent ceramic inner panel 220 that contacts and seals against the gasket (not shown) when the door 200 is closed is exemplarily illustrated by the dashed line 223. The transparent ceramic inner panel 220 includes a second, outer or perimeter portion 224 that is disposed adjacent to an area of the oven outside of the gasket (not shown) that surrounds the opening to the oven chamber, or in other words, outside the area illustrated by the dashed line 223. As a result of this arrangement, the first inner portion 222 is subjected to heating along with the oven chamber, while the second, outer or perimeter portion 224 remains at or near room temperature, thereby subjecting the transparent ceramic inner panel 220 to a temperature differential between portions 222 and 224. As shown in FIG. 6A, the transparent ceramic inner panel 220 can extend substantially from edge to edge of the door 200 in both the width direction and the height direction of the door 200 (i.e., from side 202*b* to side 202*b* in the width direction and from the top surface 202*c* to the bottom surface (202*d* in FIG. 6D) in the height direction). In other embodiments, the transparent ceramic inner panel 220 may be configured to extend to an area adjacent to one or more of the sides, top, and bottom of the door that is outside of the area illustrated by the dashed line 223.

Figure 6B:
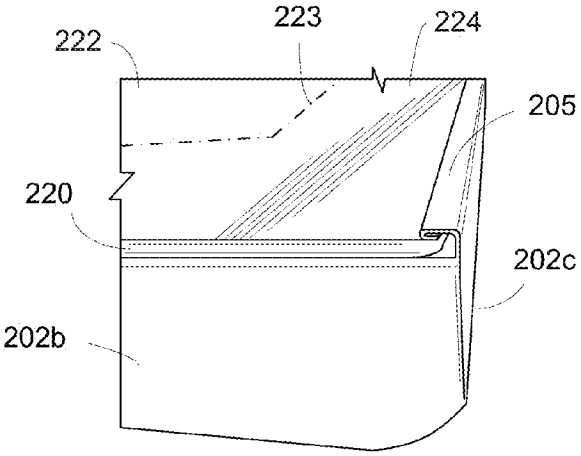
Figure 6C:
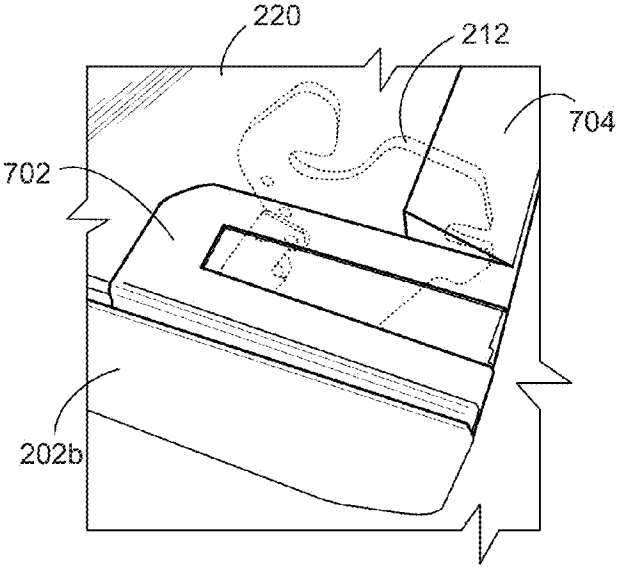
Figure 6D:
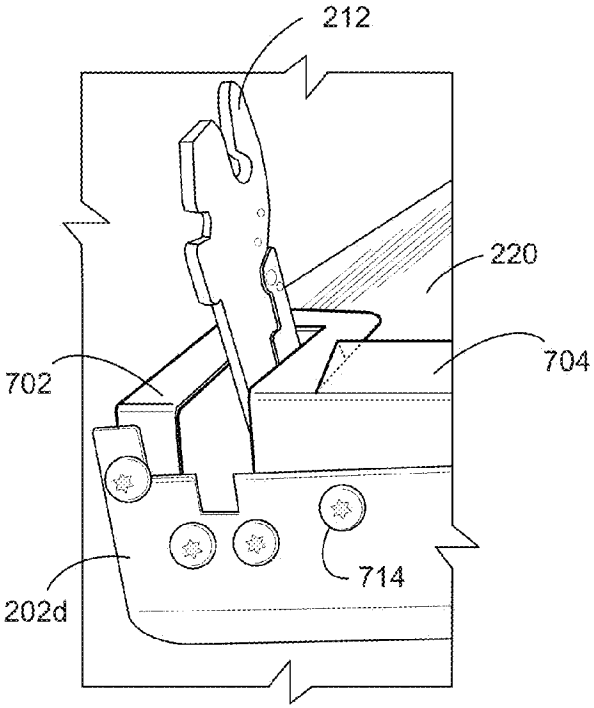

With reference to the enlargements VI-B and VI-C of FIG. 6A, which are illustrated in FIGS. 6B-6D, the exemplary door 200 can be assembled by inserting a top edge of the transparent ceramic inner panel 220 under the lip 205 of the top surface 202*c* and then resting the transparent ceramic inner panel 220 into position, as shown in FIG. 6B. The hinge claws 212 are shown in FIG. 6C using broken lines so that the features of the drip tray assembly 700 are visible.

As shown in FIGS. 6C and 6D, the transparent ceramic inner panel 220 can include a drip tray assembly 700 having an integral drip guard 704 and hinge covers 702 formed across a lower edge. When the transparent ceramic inner panel 220 is placed into position, each of the hinge covers 702 is installed over at least a portion of each lower corner of the door and can be coupled to the lower surface 202*d* of the door 200 using fasteners, such as one or more screws 714, as shown in FIG. 6D. In this way, the drip tray assembly 700 retains the ceramic transparent panel 220 in the door 200 by restraining the panel 200 at the bottom of the door 200 while at the same time covering the hinge assembly (240 in FIG. 8), as shown in FIGS. 6C and 6D.

As shown in FIGS. 6C and 6D, the hinge cover 702 can secure the transparent ceramic inner panel 220 in a dimension extending in a direction of a width of the door (i.e., from side 202*b* to side 202*b*) and in a first vertical direction of a height of the door extending from the top 202*c* toward the bottom 202*d*. The lip 205 can secure the transparent ceramic inner panel 220 in a second vertical direction of the height of the door extending the depth of the door toward the oven chamber (e.g., when the door is closed). In this way, the transparent ceramic inner panel 220 can be secured in all three dimensions by the combination of the lip 205 and the hinge cover 702, for example, without openings or fasteners extending through the transparent ceramic inner panel 220. In an embodiment, a suitable amount of clearance can be provided between the transparent ceramic inner panel 220 and the lip 205 and/or the hinge cover 702 such that the transparent ceramic inner panel 220 can "float" in the mounted position to allow for some movement for impact absorption and/or growth/expansion of the panel 220 during heating.

With reference to FIGS. 7A-7D, an exemplary embodiment of the transparent ceramic inner panel 220 having a drip tray assembly 700 will now be described.

The transparent ceramic inner panel 220 can include a first inner portion 222 that is disposed adjacent to an area within a gasket (not shown) surrounding the opening of the steam oven chamber opening (e.g., 113 in FIG. 2) and sealing the door 200 to the opening. The area of the transparent ceramic inner panel 220 that contacts and seals against the gasket (not shown) when the door 200 is closed is exemplarily illustrated by the dashed line 223. The transparent ceramic inner panel 220 can include a second, outer or perimeter portion 224 that is disposed adjacent to an area of the oven outside the area illustrated by the dashed line 223. In this example, the transparent ceramic inner panel 220 can include a hinge cutout 226 at each lower corner for accommodating or providing clearance for the door hinges, for example, without having openings or components, such as a hinge or screw, penetrating the transparent ceramic inner panel 220. The hinge cutout 226 at each corner also can provide a surface for engaging the hinge covers 702 of the drip tray assembly 700 to secure the transparent ceramic inner panel 220 in two dimensions.

The transparent ceramic inner panel 220 can have a low coefficient of thermal expansion capable of withstanding large temperature differentials across an entire surface without breaking. More particularly, the transparent ceramic inner panel 220 can be formed by a transparent ceramic material commonly used, for example, for fireplace glass (e.g., Robax® or Resistan™, manufactured by SCHOTT North America, Inc.), which can withstand large temperature differentials across its surface without breaking, and thus, may withstand the first inner portion 222 of the full glass inner surface being subjected to heating to the highest oven temperature while the second, outer or perimeter portion 224 of the full glass inner surface remains at or near room temperature. In another embodiments, the transparent ceramic inner panel 220 may include a coating such as a heat reflective coating (e.g., Energy Plus coating), which commonly may be used on fireplace glass, to assist with minimizing or reducing an external surface temperature of the door to an acceptable level.

Figure 7A:
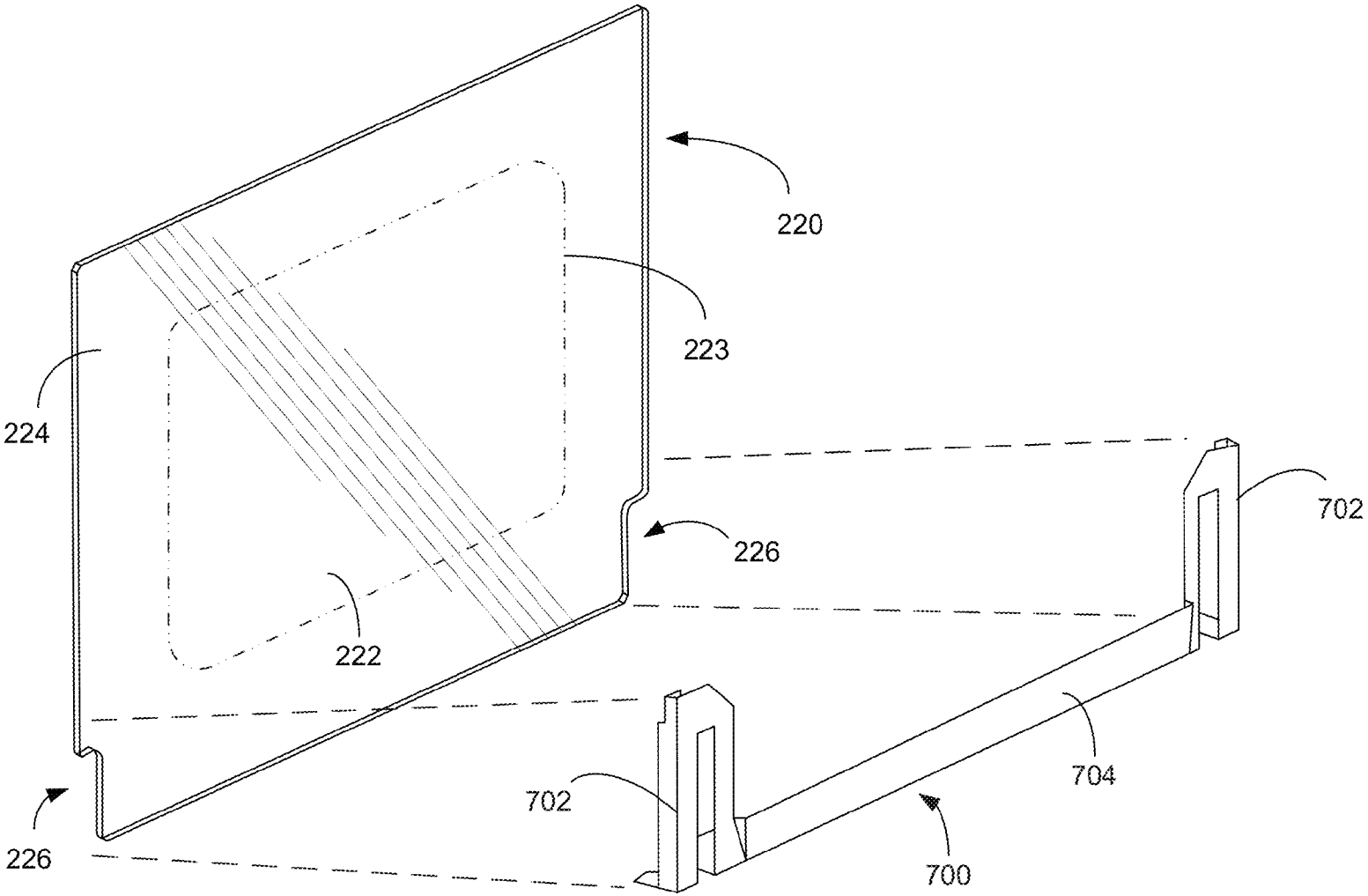
FIG. 7A is a rear perspective exploded view of a transparent ceramic inner panel and integral drip guard of a steam oven door.

With reference to FIGS. 7A-7D, the transparent ceramic inner panel 220 can include the drip tray assembly 700 having an integral drip guard 704 and hinge covers 702 formed across a lower edge. The integral drip guard 704 can be disposed between the hinge covers 702 and can form a condensation reservoir, for example, that collects and holds condensation from the transparent ceramic inner panel 220 until the condensation evaporates. In other embodiments, the drip guard 704 can channel or guide the condensation to a separately formed reservoir. In other embodiments, the drip guard can channel or guide the condensation to a drain (not shown), for example, formed in a drain pan or reservoir, for providing controlled drainage of the condensation from the transparent ceramic inner panel 220. As shown in FIG. 7A, the drip tray assembly 700 having an integral drip guard 704 and hinge covers 702 can be formed to correspond to the shape of the transparent ceramic inner panel 220, such as a shape of the cutouts 226 of the transparent ceramic inner panel 220.

Figure 7B:
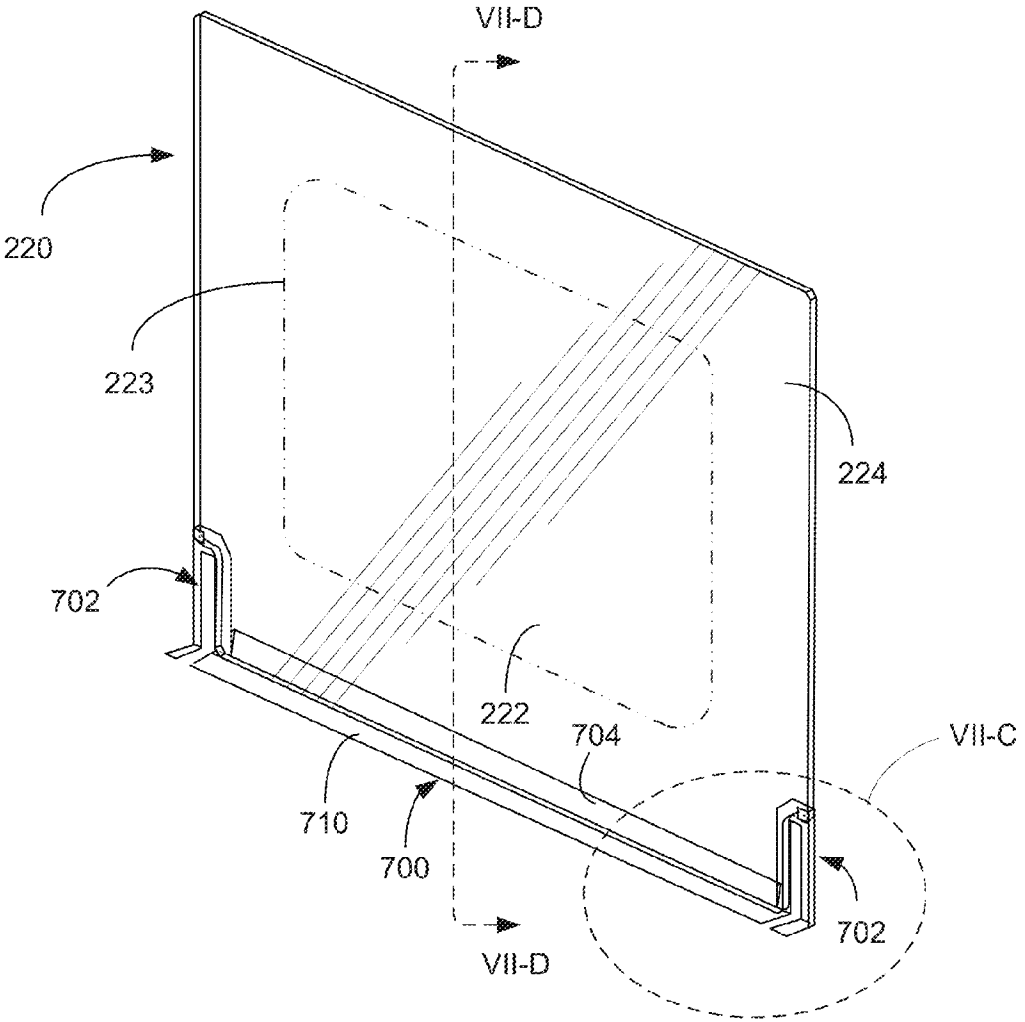
FIG. 7B is a front perspective view of a transparent ceramic inner panel and integral drip guard of a steam oven door.
Figure 7D:
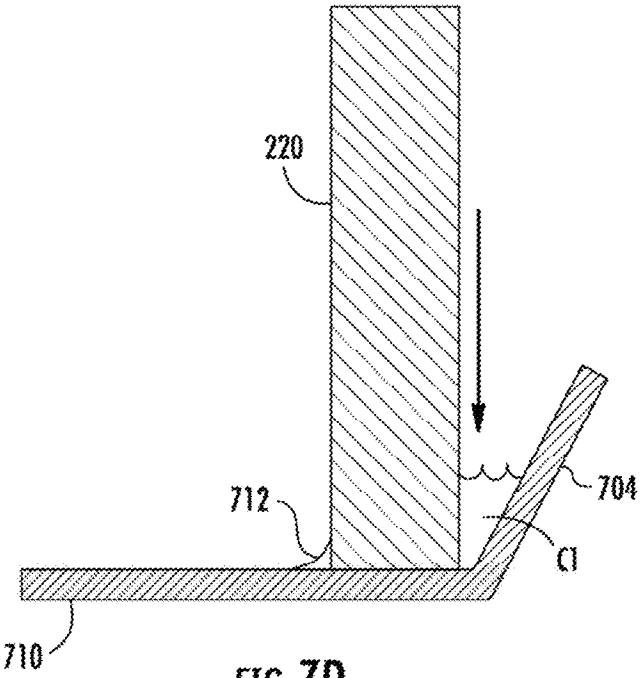
FIG. 7D is partial cross-sectional view taken along section VII-D of FIG. 7B, respectively, according to an exemplary embodiment of the invention.
Figure 7C:
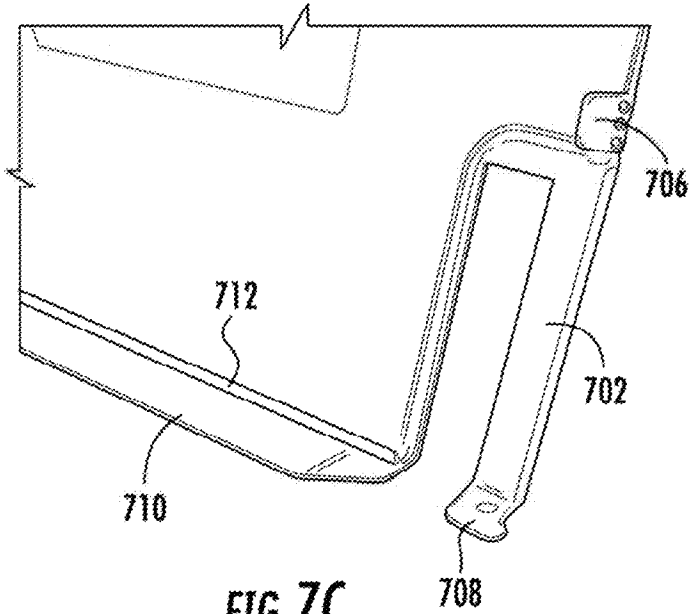
FIG. 7C is partial front perspective view of the drip guard of the steam oven door taken at VII-C of FIG. 7B.

As shown in FIG. 7B, the drip tray assembly 700 can include a plate portion 710 extending under a bottom edge of the transparent ceramic inner panel 220 and on an opposite side of the transparent ceramic inner panel 220 from the drip guard 704. The plate portion 710 can include one or more openings (not shown in FIG. 7B) for receiving one or more fasteners (e.g., 714 in FIG. 6D) for securing the drip tray assembly 700 to a bottom surface (e.g., 202*d* in FIG. 6D) of the door. As shown in FIGS. 7C and 7D, the plate portion 710 can be secured and sealed to the transparent ceramic inner panel 220, for example, by an adhesive, caulking, foam gasket, or the like (e.g., 712). The plate portion 710 can be secured/sealed to the transparent ceramic inner panel 220 along substantially an entire length of the bottom edge of the transparent ceramic inner panel 220. In other embodiments, the adhesive, caulking, foam gasket, or the like (e.g., 712) can be formed at one or more locations, such as one or more equally spaced locations along a length of the inner panel 220. As shown in FIG. 7C, the drip tray assembly 700 can include one or more locating features 706 that can be folded, pressed, or otherwise formed around a portion of the transparent ceramic inner panel 220 to secure a portion (e.g., upper portion) of the hinge covers 702 to the transparent ceramic inner panel 220. The locating features 706 can provide a self locating feature for gluing the drip try assembly 700 to the inner panel 220.

With reference again to FIG. 7D, the drip tray assembly 700 can include an integral drip guard 704 extending upwards from a bottom edge, or a region adjacent to the bottom edge, of the transparent ceramic inner panel 220 and along a face of the transparent ceramic inner panel 220. The drip guard 704 can be formed at an angle, as shown in FIG. 7D, such that condensation C1 running down the face of the transparent ceramic inner panel 220 can collect in a space formed between the drip guard 704 and a surface of the transparent ceramic inner panel 220. The drip guard 704 can form a reservoir in which the condensate C1 collects until the condensate C1 evaporates. In other embodiments, the drip guard 704 can include an additional wall (not shown) abutting a surface of the transparent ceramic inner panel 220 and forming a reservoir separate from the surface of the transparent ceramic inner panel 220. The additional wall (not shown) can be sealed to the face of the transparent ceramic inner panel 220 in addition to, or in lieu of, the adhesive, caulking, foam gasket, or the like (e.g., 712). The ends of the drip guard 704 can be joined to the hinge covers 702 to prevent the collected condensate C1 from running out of the ends of the drip guard 704, or the ends can be open. The drip guard 704 can have a substantially level floor or be angled, for example, to cause the condensate C1 to collect toward the central part of the length of the transparent ceramic inner panel 220 rather than at the ends of the drip guard 704. Alternatively, the drip guard 704 can be angled, for example, to cause the condensate C1 to collect toward one or more ends of the length of the transparent ceramic inner panel 220 rather than at the center of the drip guard 704.

In other embodiments, the drip guard 704 can have a curved cross-section, a rectangular or square cross-section, or other shape that is suitable for collecting condensate. The drip guard 704 can be integrally formed with the hinge covers 702, as illustrated in the exemplary embodiments, or separately formed from the hinge covers 702. The drip guard 704 can be configured to collect all of the condensate C1 on one side of the transparent ceramic inner panel 220 (e.g., an inner side facing the oven chamber). In other embodiments, the drip guard 704 can be configured to collect part of all of the condensate C1 under the transparent ceramic inner panel 220, on an opposite side of the transparent ceramic inner panel 220, or in one or more locations with respect to the transparent ceramic inner panel 220.

Figure 8:
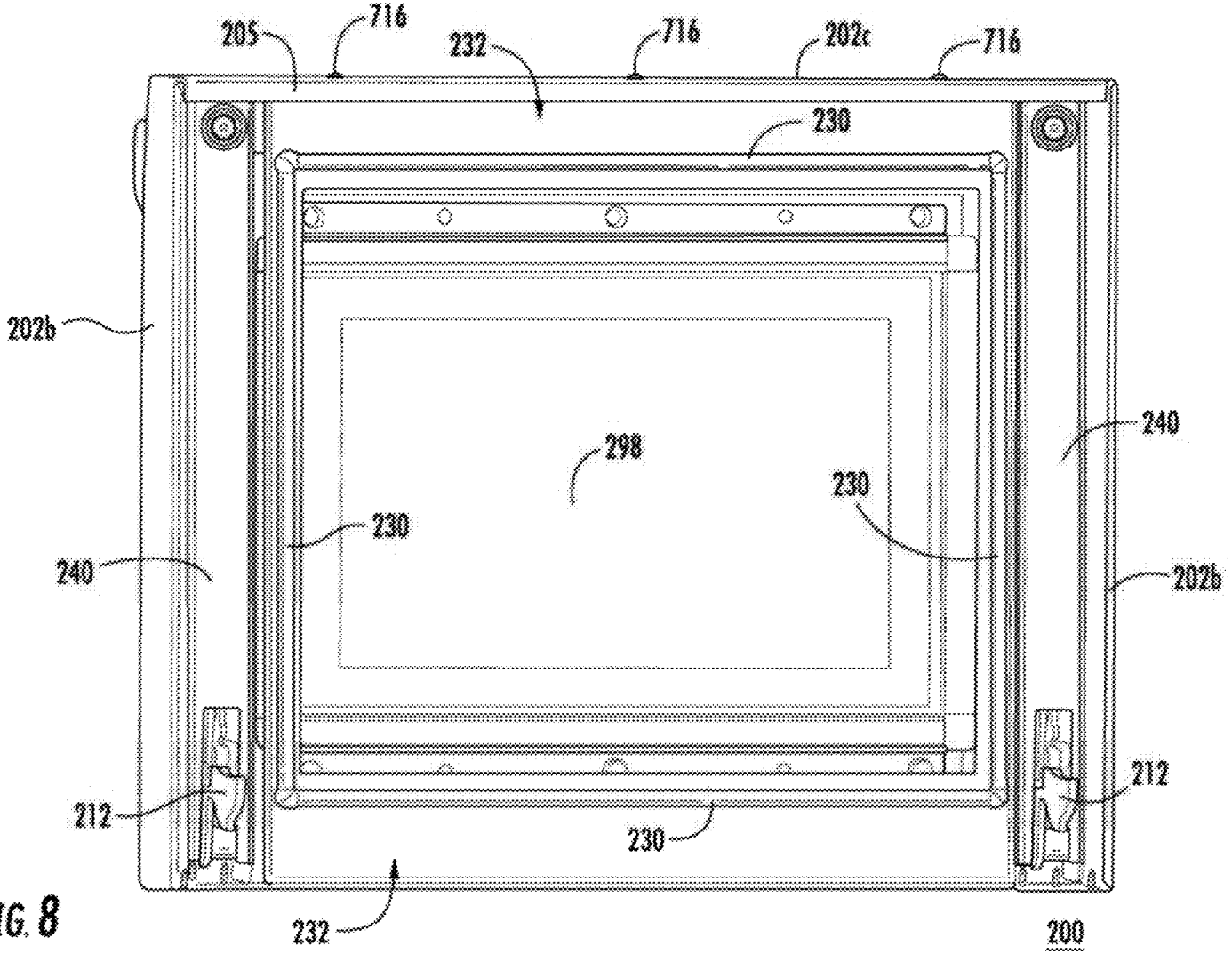
FIG. 8 is a rear perspective view of a partially assembled steam oven door having an inner glass shock absorbing support system according to an exemplary embodiment of the invention.
Figure 9B:
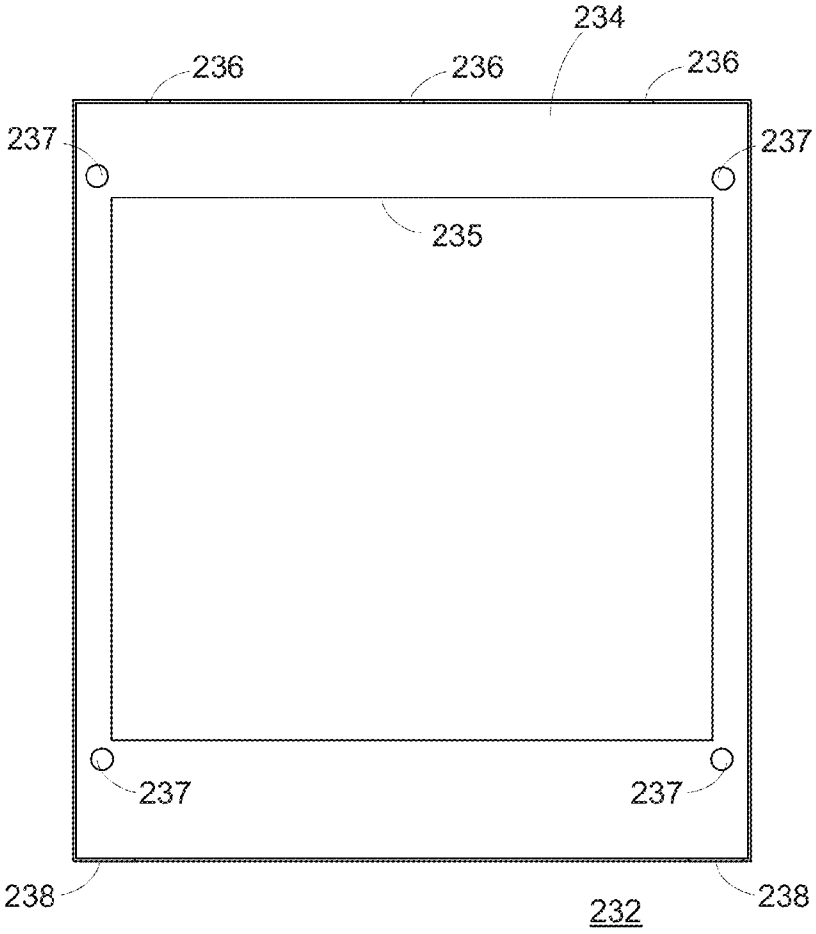
FIGS. 9A and 9B are a front perspective view and a front plan view, respectively, of a cavity (inner) glass retainer according to an exemplary embodiment of the invention.
Figure 9A:
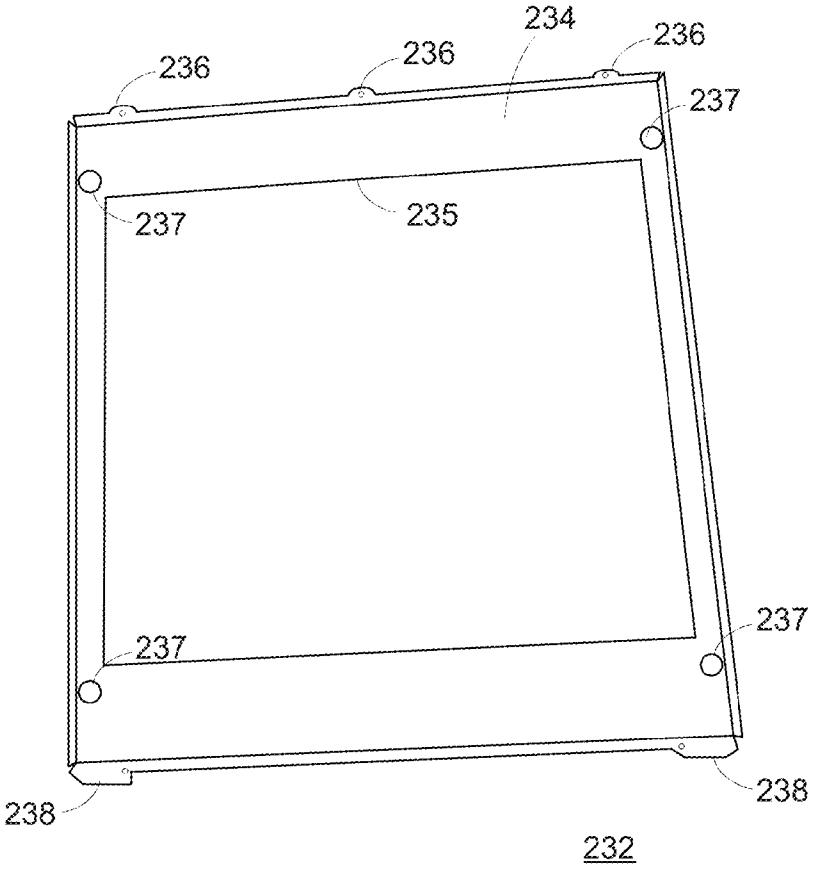
Figures 9C, 9D, 9E:
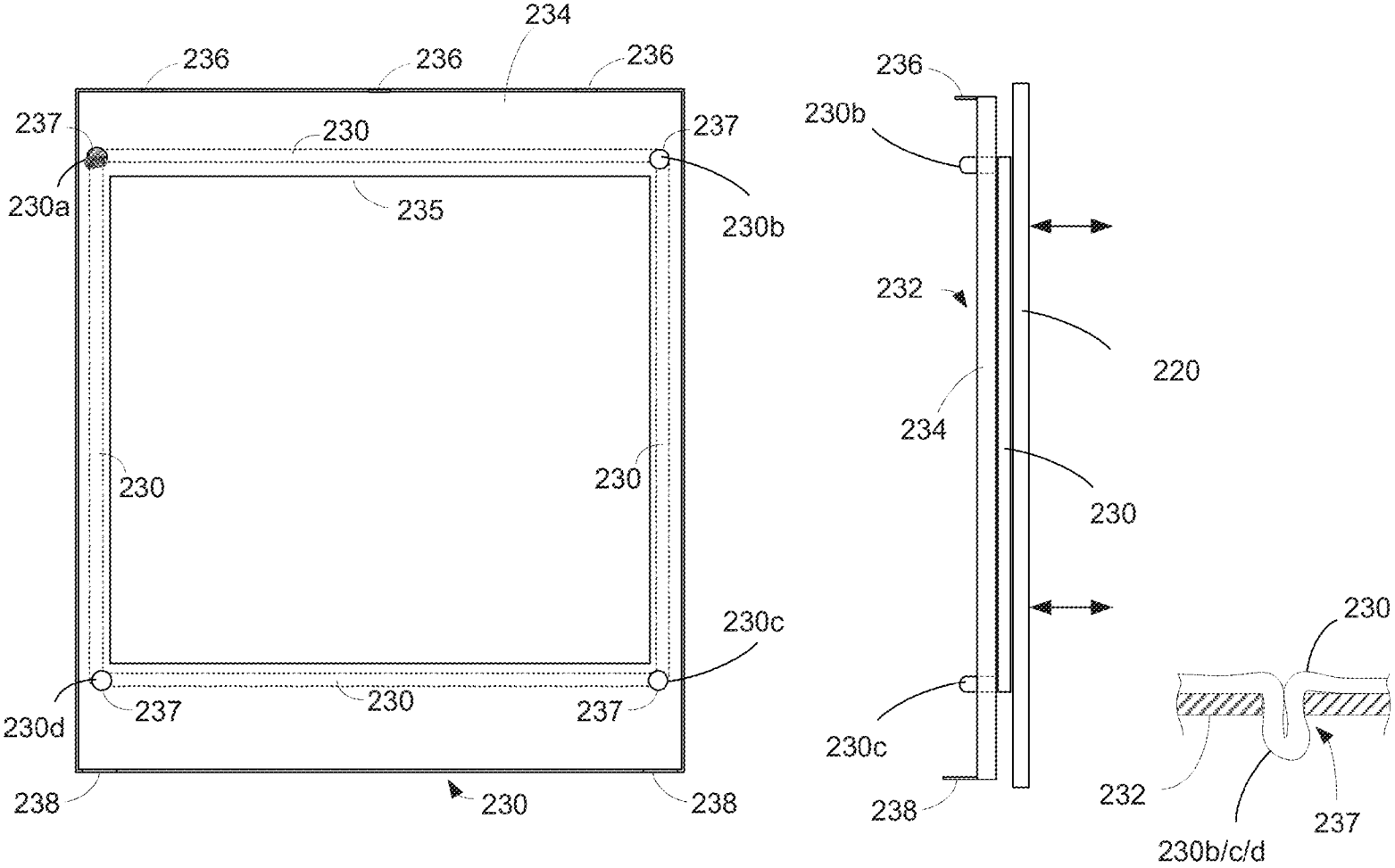
FIGS. 9C and 9D are a front plan view and a side view, respectively.
FIG. 9E is an partial cutaway view of elements of an inner glass shock absorbing support system according to an exemplary embodiment of the invention.

With reference to FIGS. 8-9D, an exemplary embodiment of an inner glass shock absorbing support system for a steam oven door will now be described.

FIG. 8 illustrates the door 200 with the transparent ceramic inner panel 220 removed. As shown in FIG. 8, the door 200 can include a side surface 202*b* and a top surface 202*c* having a lip 205 for retaining an upper edge of the transparent ceramic inner panel 220. The top surface 202*c* can include one or more fasteners 716 for coupling, for example, an internal frame or plate (232 in FIG. 9A) to the door 200. The door 200 can include a hinge assembly 240 on each side, such as an off-the-shelf hinge assembly, having hinge claws 212 to facilitate movement of the door 200 between the open and closed positions. In FIG. 8, the transparent ceramic inner panel 220 has been removed to provide a better understanding of the internal features of the door 200. The outer glass panel 298 is visible within the door 200, along with components of the outer glass panel 298 mounting system, which will be described with reference to FIGS. 10-14.

With reference again to FIG. 8, the door 200 can include an inner glass shock absorbing support system having an energy absorbing support means (e.g., shock absorbing support means, such as 230) for evenly, flexibly, and resiliently supporting the transparent ceramic inner panel 220 in a manner that permits the transparent ceramic inner panel 220 to "float" in the mounted position to allow for some movement for shock/impact absorption. In this way, the shock absorbing support means can absorb and distribute forces (e.g., shock or impact forces from a dropped pot or pan, etc.) exerted on the transparent ceramic inner panel 220 to prevent the panel 220 from breaking or fracturing and to enable the panel 220 to comply with ratings agencies and industry/government standards.

More particularly, the shock absorbing support means can include, for example, one or more flexible, compressible, or resilient parts or mounts configured to absorb and distribute forces exerted on the transparent ceramic inner panel 220, such as forces exerted by a user dropping a pot or pan on the open door while loading or unloading the cooking appliance. In the example illustrated in FIG. 8, the shock absorbing support means can include a flexible rope gasket 230 or the like for suspending the transparent ceramic inner panel 220 within the door 200 in a manner that flexibly supports a surface of the transparent ceramic inner panel 220 and that permits the transparent ceramic inner panel 220 to "float" in the mounted position to allow for some movement for impact absorption. The rope gasket can include, for example, a knitted type E fiberglass rope. The rope gasket 230 can be supported or secured in position with respect to the transparent ceramic inner panel 220 by an internal frame or plate 232. More particularly, the rope gasket 230 can be threaded into openings in a metal retainer, internal frame, or plate 232 that is coupled to the door skin. In other embodiments, the shock absorbing support means can include a flexible or deflectable metal support, such as a flexible or deflectable metal support frame, and/or an insulation layer disposed between a surface of the internal frame or plate 232 and a surface of the transparent ceramic inner panel 220. For example, the inner glass shock absorbing support system can include a support formed by a thin, flexible material (e.g., metal) support frame disposed around a perimeter of a viewing area through the glass panels of the door 220.

An example of an internal frame or plate 232 having a flexible rope gasket 230 will be described in greater detail with reference to FIGS. 9A-9E.

As shown in FIGS. 9A and 9B, the shock absorbing support means can include an internal frame or plate 232 for supporting or securing the flexible rope gasket 230. The internal frame or plate 232 can include a body portion 234 having an opening 235 to permit viewing through the plate 232, as well as to reduce a thermal mass of the plate 232 and reduce or minimize the plate 232 acting as a heat sink. As shown in FIG. 9A, the internal frame or plate 232 can include one or more upper mounting brackets or flanges 236 and one or more lower mounting brackets or flanges 238 for securing the plate 332 to the door. The upper mounting brackets or flanges 236 can be coupled to the top surface (202*c* in FIG. 8) via one or one or more fasteners (716 in FIG. 8). The lower mounting brackets or flanges 238 can be coupled to the bottom surface (202*d* in FIG. 6D) via one or one or more fasteners (714 in FIG. 6D). As shown in FIGS. 9A and 9B, the internal frame or plate 232 can include a plurality of openings 237 disposed, for example, adjacent to each corner of the plate 232 or opening 235 of the plate 232. In other embodiments, the plate 232 can include one or more additional openings, slots, etc. (not shown) for reducing the thermal mass of the plate 232.

With reference to FIGS. 9C-9E, a flexible rope gasket 230 having heat resistant properties can be secured/supported on the plate 232 such that the rope gasket 230 extends around a perimeter of the opening 235 of the plate 232. In operation, portions of the rope gasket 230 can be inserted or tucked into each of the openings 237 of the plate 232. For example, a first end 230*a* of the rope gasket 230 can be inserted into a first opening 237. Next, the rope gasket 230 can be extended along an edge of the opening 235 of the plate 232 to a second opening 237 and disposed across the second opening 237. A second portion 230*b* of the rope gasket 230 then can be pushed/tucked into the second opening 237, as shown for example in FIGS. 9D and 9E. The rope gasket 230 can be extended to a third opening 237 and a third portion 230*c* of the rope gasket 230 can be tucked into the third opening 237, as shown again in FIGS. 9D and 9E. The rope gasket 230 can be extended back to the first opening 237 and a fourth portion (end portion) 230*d* of the rope gasket 230 can be tucked into the first opening 237, as shown in FIG. 9C, thereby completing the installation of the rope gasket 230 on the plate 232. As shown in FIG. 9D, the flexible rope gasket 230 can permit the transparent ceramic inner panel 220 to "float" or move in the direction of the arrows with respect to the frame or plate 232, thereby resiliently and flexibly supporting the transparent ceramic inner panel 220 in a "floating" manner (i.e., movable manner) to provide impact absorption. One of ordinary skill in the art will recognize that all of the support means are not necessary and various combinations of these elements can support the transparent ceramic inner panel 220 in a "floating" manner (i.e., movable manner) to provide impact absorption. The door 200 also can include additional or alternative flexible support means in combination with the illustrated examples. The present invention is not limited to the illustrated examples and other flexible support means are contemplated by the present invention. According to the exemplary embodiment, the shock absorbing support means can provide controlled movement (e.g., limited controlled movement) to absorb energy exerted on the transparent ceramic inner panel 220 and prevent breakage of the transparent ceramic inner panel 220. One of ordinary skill in the art will recognize that the rope gasket 230 can be configured in a variety of ways and can have a variety of sizes and shapes configured to provide impact absorption and/or to cooperate with the plate 232 and the inner panel 220. The rope gasket 230 can include a plurality of portions configured to flex or deflect under the influence of one or more predetermined amounts of force. The rope gasket 230 can have a uniform thickness or a plurality of portions having a different thickness, for example, to facilitate flexing or deflecting upon the application of different amounts of force.

With reference to FIGS. 10-14, an exemplary embodiment of an outer glass mounting system will now be described. The mounting system for the outer glass panel 298 can secure the cosmetic outer glass panel tightly against the stainless steel door skin 202*a* such that no gaps are visible between the outer glass panel and the door skin at a top, bottom, left, or right of the glass panel 298. The mounting system for the outer glass panel 298 can be configured to minimize or eliminate any visible marks or fasteners on the exterior of the door skin 202*a*. The outer glass panel 298 can be formed, for example, from soda lime glass with low iron content.

Figure 10:
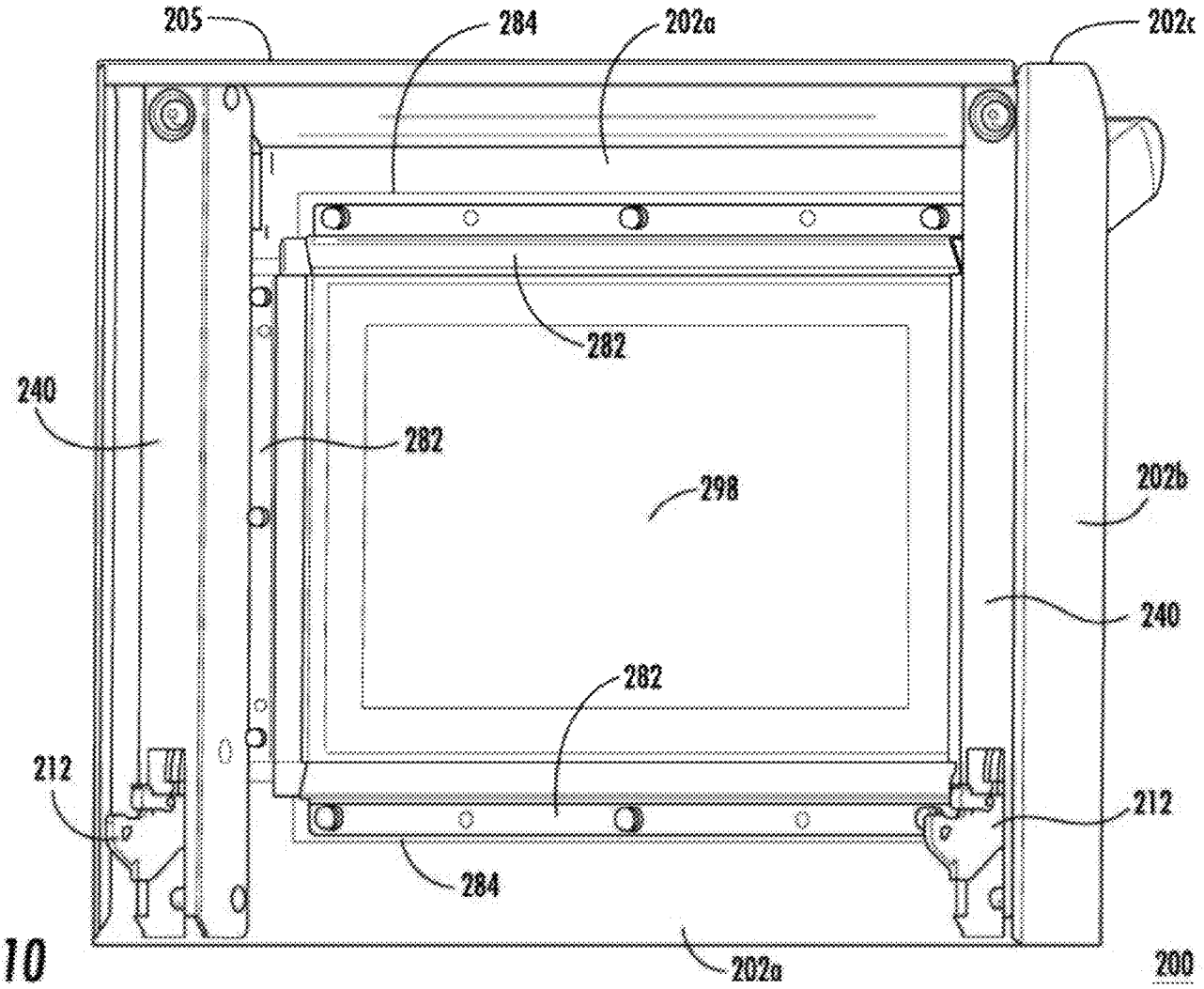
FIG. 10 is a rear perspective view of a partially assembled steam oven door having an outer glass mounting system according to an exemplary embodiment of the invention.

With reference to FIG. 10, an exemplary embodiment of the oven door 200 can include an outer glass panel 298 that can be secured to the door skin 202*a* by a plurality of brackets 282. FIG. 10 shows an upper bracket 282, lower bracket 282, and left-hand bracket 282. The outer glass mounting system also can include a right-hand side bracket, which are not visible in FIG. 10.

Figure 11:
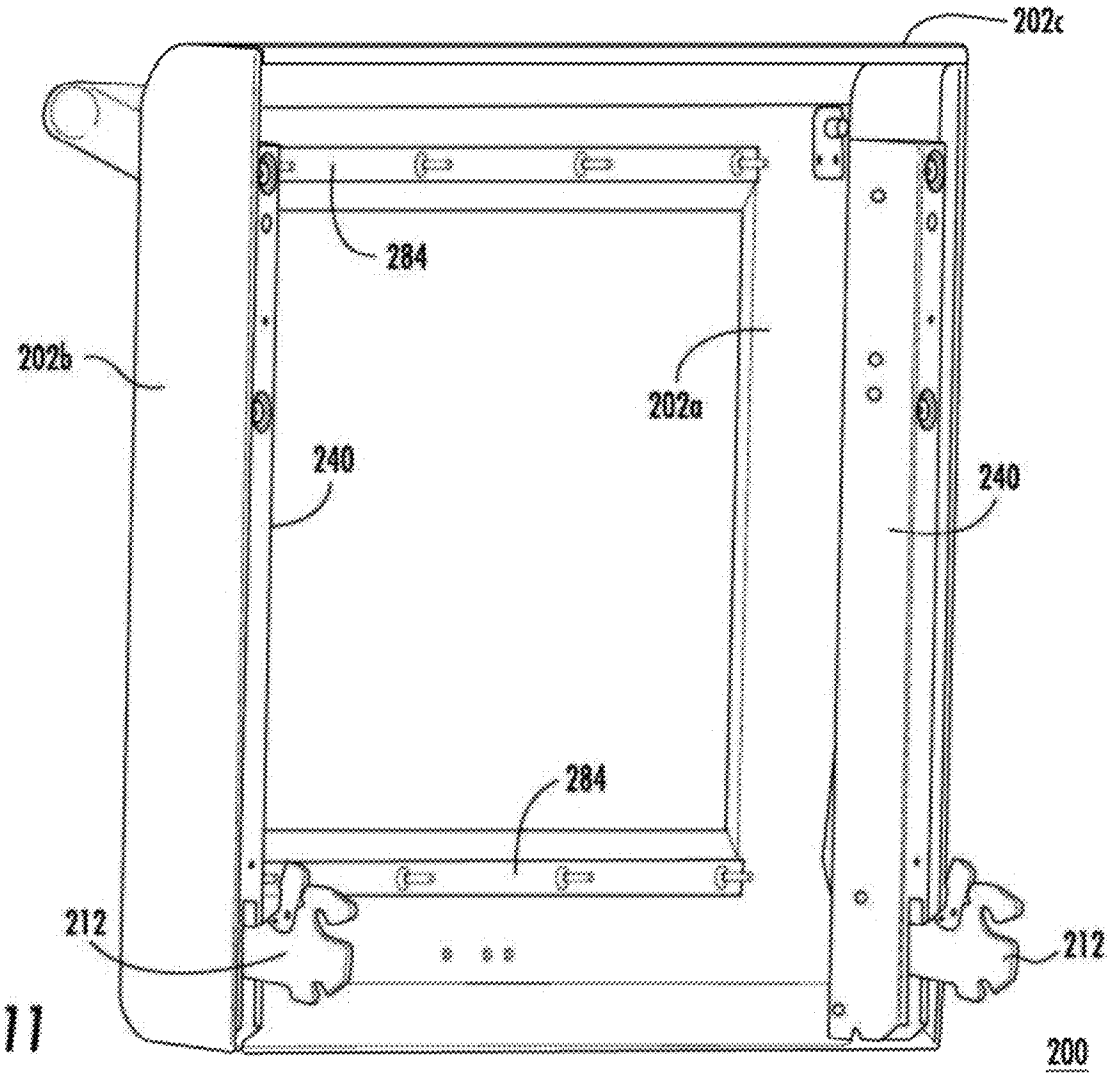
FIG. 11 is a rear perspective view of a partially assembled steam oven door having elements of an outer glass mounting system according to an exemplary embodiment of the invention.

With reference to FIG. 11, an exemplary embodiment of the oven door 200 can include a plurality of strips 284 (e.g., metal pin strips) coupled to the door skin 202*a* for coupling the brackets (282 in FIG. 10) to the door skin 202*a* without marking an exterior side of the door skin 202*a*. FIG. 11 shows the door skin 202*a* without the outer glass panel 298.

Figure 12A:
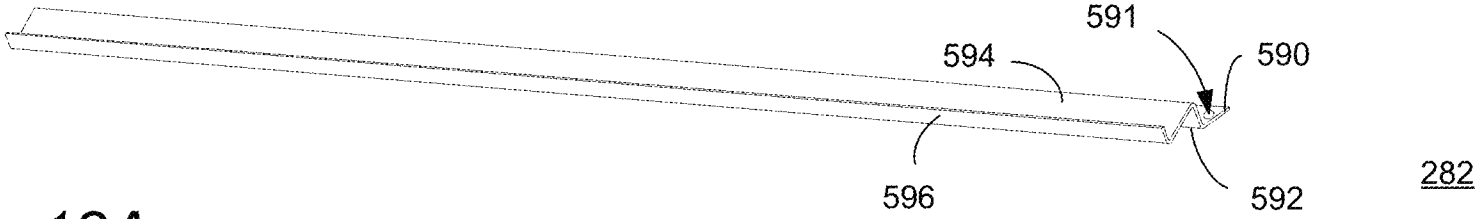
FIGS. 12A and 12B are a perspective view and an end view, respectively, of an outer glass bracket of an outer glass mounting system according to an exemplary embodiment of the invention.
Figure 12B:
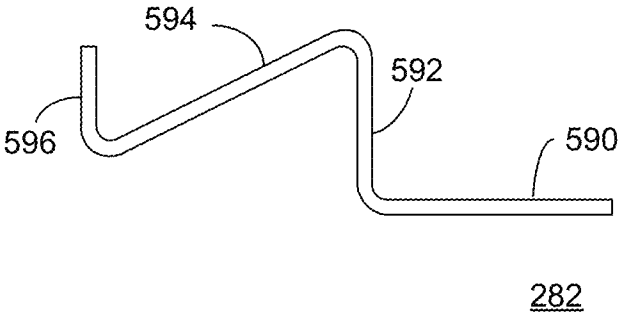

With reference to FIGS. 12A and 12B, the brackets 282 may be Z-brackets including with designed-in interference to press the outer glass panel 298 firmly against the door skin by holding the panel 298 at the edges, for example, in a manner similar to a "rabbet" on a back of a picture frame. The bracket 282 can include a Z-shaped cross-section formed by portions 590, 592, 594, and 596. The portion 590 can be a base portion having a plurality of openings 591 for engaging one or more fasteners, such as threaded studs 604 in FIG. 11 (and described with reference to FIGS. 13A and 13B) to secure the bracket 282 to the door skin.

Figure 13A:
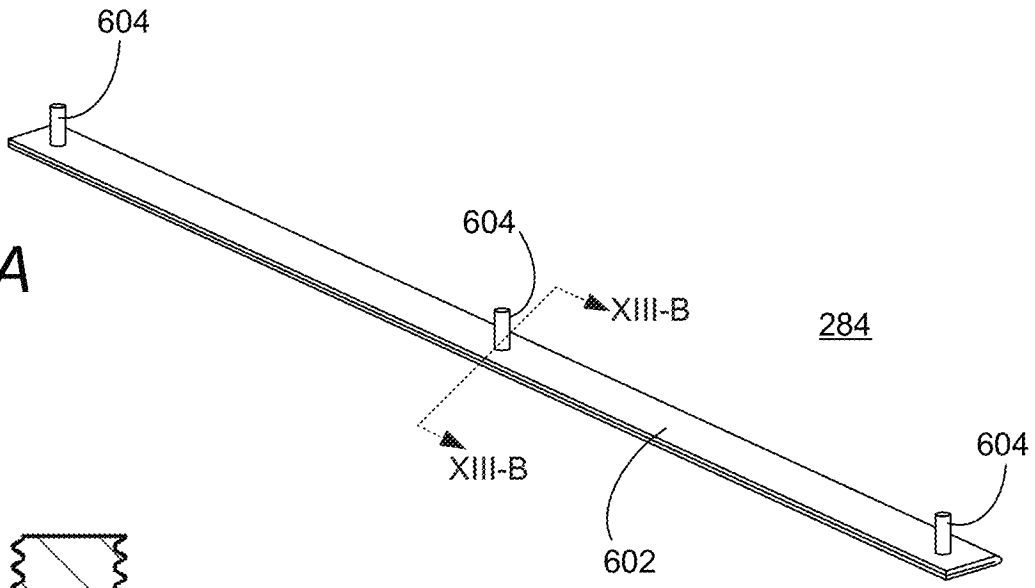
FIGS. 13A and 13B are a perspective view of a stud strip of an outer glass mounting system according to an exemplary embodiment of the invention, and a cross-sectional view of the stud strip taken along section XIII-B of FIG. 13A, respectively.
Figure 13B:
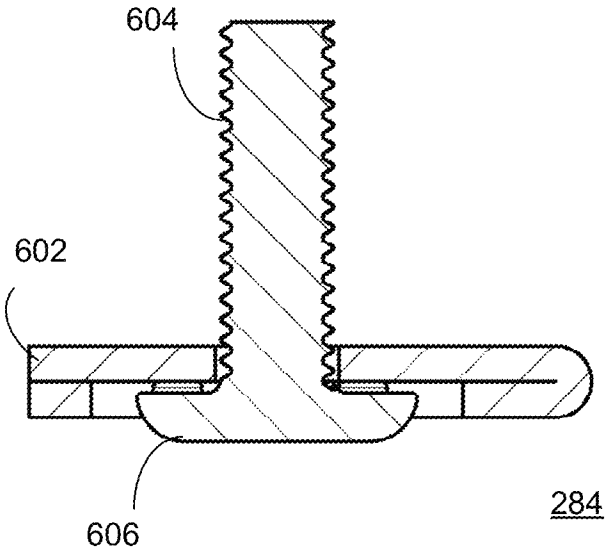

With reference to FIGS. 13A and 13B, an exemplary strip 284 can include a plate portion 602 having a plurality of studs 604, such as threaded studs for receiving a nut in threaded engagement. In other embodiments, the studs 604 can include other fastening means, such as an internal bore for receiving a screw or bolt, a notch or groove for receiving a retainer clip or o-ring, etc. As shown in FIG. 13B, an exemplary embodiment of the strip 284 can be formed by inserting a plurality of threaded studs 604 having heads 606 through openings formed in the plate portion 602. The studs 604 can be coupled to the plate portion 602 by means, such as welding, or formed by stamping a shape into the plate portion 602.

Figure 14:
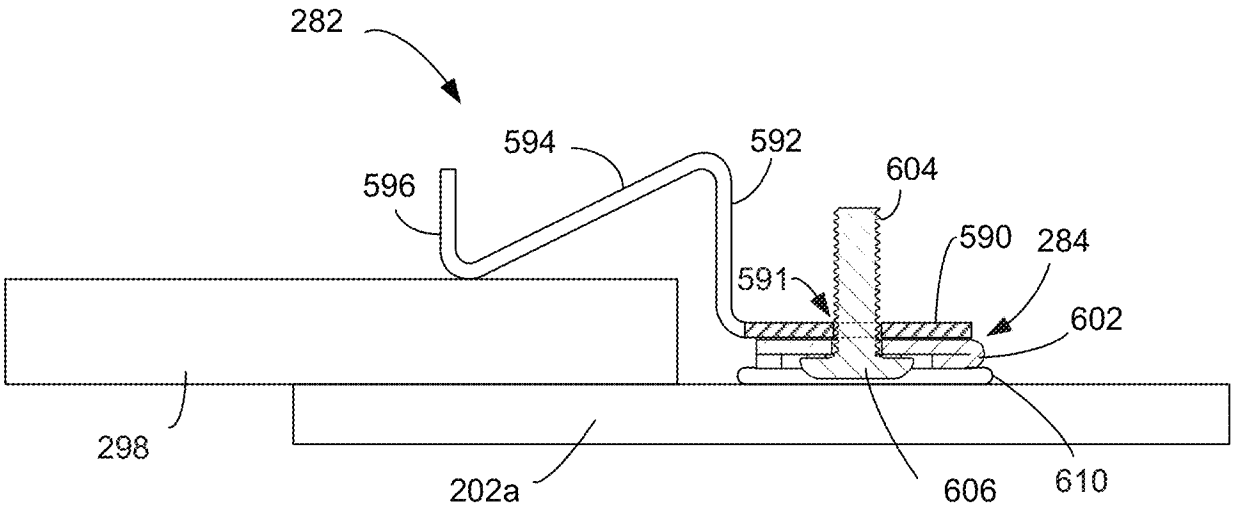
FIG. 14 is partial side, cross-sectional view of an outer glass mounting system according to an exemplary embodiment of the invention.

With reference to FIG. 14, in operation, the cosmetic glass outer panel 298 ("skin" or "outer" glass) can be placed centered inside the door skin 202*a* at a correct position. The strips 284 having the threaded studs 604 can be secured to the inside of the door skin 202*a*, around a perimeter of the outer glass panel 298 using, for example, adhesive tape 610 or the like. In other embodiments, the strips 284 can be secured to the door skin 202*a* using other coupling means, such as adhesive paste, welding, soldering, etc. If an adhesive is used, then the door can be configured such that a temperature at the door skin where the tape is attached to the door skin 202*a* does not exceed an allowable temperature for the adhesive. In this way, the strips 284 can be coupled to the interior surface of the door skin 202*a* without penetrating or marking an exterior of the door skin 202*a*, thereby maintaining a desired cosmetic appearance of the door skin 202*a*. A nut (not shown in FIG. 14) can be threaded onto the stud 604 to secure the bracket 282 in place and providing a tight, gap-free fit of the outer glass panel 298 to the door skin 202*c*.

According to the exemplary embodiments, the outer glass panel mounting system can minimize or eliminate turbulent air flow through door and cosmetic blemishes on the exterior of the door skin, while providing a tight, gap-free fit of outer glass panel to door skin that remains securely attached to the door skin through a full operating temperature range of the appliance, including a self-cleaning process. The outer glass panel mounting system also can provide the ability to remove the outer glass panel for service without breaking/reapplying adhesive.

Figure 15B:
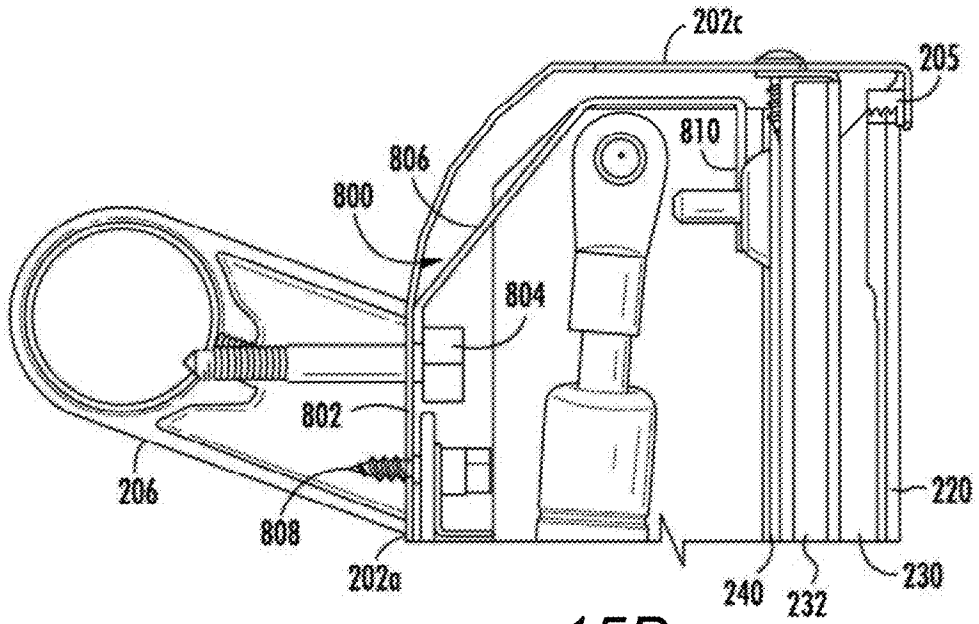
FIG. 15B is a cut-away, partial side view of a door having the hinge retainer assembly of FIG. 15A.
Figure 15A:
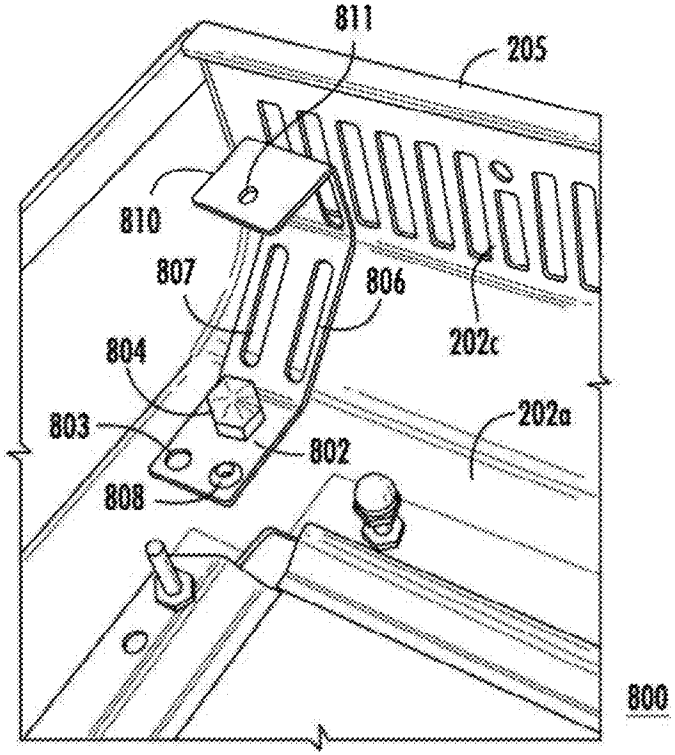
FIG. 15A is partial perspective view of a door having a hinge retainer assembly according to an exemplary embodiment of the invention.

As explained, the full transparent ceramic inner panel 220 extends across the width and height of the inner surface of the door, and therefore, the door does not include a porcelain liner or plunger, which conventionally may be used to mount the door hinge assemblies. With reference to FIGS. 15A and 15B, an exemplary embodiment of a hinge retainer system, which can be used to couple a hinge assembly to a door skin of a door having a full glass inner panel, will now be described.

A lower end of a hinge assembly (240 in FIG. 8) can be coupled to the bottom end of the door skin (as shown in FIG. 6D). With reference to FIGS. 15A and 15B, an upper end of a hinge assembly (240 in FIG. 15B) can be coupled to the door skin 202*a* with a hinge retainer 800. As shown in FIG. 15A, an exemplary embodiment of a hinge retainer 800 can include a body/plate portion 802 having one or more openings 803 for receiving and engaging one or more fasteners (e.g., 804, 808). The hinge retainer 800 can include a side wall 806 extending from the plate portion 802. The side wall 806 can extend perpendicular to the plate portion 802, as shown in FIG. 15A, or alternatively, at an angle to the plate portion 802. The hinge retainer 800 can include a mounting flange 810 having, for example, an opening 811 for receiving a fastener (not shown in FIG. 15A) to couple an upper end of a hinge assembly (240 in FIG. 15B) to the hinge retainer 800. The side wall 806 can include one or more cutouts, slots, or perforations 807 for minimizing a thermal mass of the hinge retainer 800 in order to assist with reducing external door surface temperatures. As shown in FIG. 15A, the hinge retainer 800 can be coupled to the door skin 202*a* in a corner region of the door, for example, adjacent to the side surface 202*b* and the top surface 202*c*, which includes the lip 205.

FIG. 15B shows a partial cutaway view of an upper region of the door showing an exemplary arrangement of the door handle mount 206, door skin 202*a*, and top surface 202*c*. The lip 205 of the top surface 202*c* is visible in FIG. 15B, along with the fastener (threaded screw 716) coupling the internal frame or plate 232 to the top surface 202*c*. The rope gasket 230 is disposed between the plate 232 and the outer glass panel 220. FIG. 15B also shows the arrangement of an upper end of each of the metal strip 284, the bracket 280, and the hinge assembly 240.

As shown in FIG. 15B, the hinge retainer 800 can couple an upper end of the hinge assembly 240 to the door skin 202*a* in a corner region of the door, for example, adjacent to the top surface 202*c*. The fastener 804 can be configured to engage an opening (803 in FIG. 15A) in the body/plate portion 802 of the hinge retainer 800 and extend through a corresponding opening in the door skin 202*a* that is disposed adjacent to the door handle mount 206 such that the fastener 804 couples the body/plate portion 802 of the hinge retainer 800 and the handle mount 206 to the door skin 202*a*. The fastener 804 can be concealed from view by the door handle mount 206 when installed. The fastener 808 also can be configured to engage another opening (803 in FIG. 15A) in the body/plate portion 802 of the hinge retainer 800 and extend through a corresponding opening in the door skin 202*a* that is concealed from view by the door handle mount 206 when installed. The side wall 806 extends from the body/plate portion 802, on one end, to the mounting flange 810, on the other end. The mounting flange 810 can be coupled to the upper portion of the hinge assembly 240 by one or more fasteners 812. According to the exemplary embodiments illustrated in FIGS. 15A and 15B, the hinge retainer 800 can be used to couple the upper end of the hinge assembly 240 to the door skin 202*a* of a door having a full glass inner panel (i.e., without a "plunger") without any markings, fasteners, etc. being visible from an outside of the door.

The present invention has been described herein in terms of several preferred embodiments. However, modifications and additions to these embodiments will become apparent to those of ordinary skill in the art upon a reading of the foregoing description. It is intended that all such modifications and additions comprise a part of the present invention to the extent that they fall within the scope of the several claims appended hereto.

What is claimed is:

1. A household cooking appliance comprising:

a housing having an oven chamber accessible through an opening, the opening having a seal surrounding a perimeter of the opening; and an oven door covering the opening and moveable about a hinge between an open position and a closed position, the oven door including:

an outer door skin having an outer glass panel;

a full glass inner panel having an inner surface that abuts the seal when the oven door is in a closed position, the full glass inner panel closing an inner side of the outer door skin; and an integrated drip tray assembly that collects condensation from the full glass inner panel, the integrated drip tray assembly being sealed to the full glass inner panel, wherein the drip tray assembly includes an integral drip guard sealed to the full glass inner panel, and wherein the drip tray assembly further includes an integral hinge cover.

2. The household cooking appliance of claim 1, wherein the integral drip guard is sealed to the bottom edge of the full glass inner panel.

3. The household cooking appliance of claim 2, wherein the integral drip guard extends substantially across the bottom edge of the full glass inner panel.

4. The household cooking appliance of claim 3, wherein the integral drip guard is sealed to the bottom edge of the full glass inner panel substantially across the bottom edge of the full glass inner panel.

5. The household cooking appliance of claim 1, wherein the integral hinge cover includes one of a locating tab and a locating projection that controls a position of the drip tray assembly with respect to the full glass inner panel.

6. The household cooking appliance of claim 1, wherein the integral hinge cover is disposed adjacent to the hinge of the oven door, the integral hinge cover retaining a corner area of the full glass inner panel.

7. The household cooking appliance of claim 6, wherein a perimeter of the full glass inner panel includes a cutout corresponding to the hinge and the hinge cover, wherein the hinge cover engages an edge of the cutout to retain the full glass inner panel.

8. A household cooking appliance comprising:

a housing having an oven chamber accessible through an opening, the opening having a seal surrounding a perimeter of the opening; and an oven door covering the opening and moveable about a hinge between an open position and a closed position, the oven door including:

an outer door skin having an outer glass panel;

a full glass inner panel having an inner surface that abuts the seal when the oven door is in a closed position, the full glass inner panel closing an inner side of the outer door skin; and an integrated drip tray assembly that collects condensation from the full glass inner panel, the integrated drip tray assembly being sealed to the full glass inner panel;

wherein the drip tray assembly includes an integral drip guard sealed to the full glass inner panel;

wherein the drip tray assembly further includes a pair of integral hinge covers on opposing ends of the full glass inner panel, and wherein the integral drip guard is disposed between the pair of integral hinge covers.

9. The household cooking appliance of claim 1, wherein the drip tray assembly further includes a reservoir that collects condensation from the full glass inner panel.

10. The household cooking appliance of claim 1, wherein the integral drip guard cooperates with a surface of the full glass inner panel to form a reservoir that collects condensation from the full glass inner panel.

11. The household cooking appliance of claim 1, wherein the drip tray assembly further includes a plate portion extending under the bottom edge of the full glass inner panel and on an opposite side of the full glass inner panel from the integral drip guard.

12. The household cooking appliance of claim 11, wherein the plate portion is sealed to the bottom edge of the full glass inner panel substantially across the bottom edge of the full glass inner panel.

13. The household cooking appliance of claim 11, wherein the plate portion is coupled to the outer door skin.

14. A household cooking appliance comprising:

a housing having an oven chamber accessible through an opening, the opening having a seal surrounding a perimeter of the opening; and an oven door covering the opening and moveable about a hinge between an open position and a closed position, the oven door including:

an outer door skin having an outer glass panel;

a full glass inner panel having an inner surface that abuts the seal when the oven door is in a closed position, the full glass inner panel closing an inner side of the outer door skin;

an integrated drip tray assembly that collects condensation from the full glass inner panel, the integrated drip tray assembly being sealed to the full glass inner panel; and shock-absorbing means for absorbing and distributing shocks and impacts on the full glass inner panel.

15. The household cooking appliance of claim 14, wherein the shock-absorbing means includes a support plate having a rope gasket resiliently and movably supporting the full glass inner panel.

16. The household cooking appliance of claim 15, wherein the support plate is coupled to a top surface of the outer door skin and a bottom surface of the outer door skin.

17. The household cooking appliance of claim 15, wherein the support plate includes a first opening for viewing through the support plate, the rope gasket extending around a perimeter of the first opening.

18. The household cooking appliance of claim 17, wherein the support plate includes a plurality of second openings disposed around the perimeter of the first opening, the rope gasket engaging each of the plurality of second openings.

19. The household cooking appliance of claim 1, wherein the oven door further comprises:

means for movably supporting the full glass inner panel without penetrating through the inner surface of the full glass inner panel.

20. The household cooking appliance of claim 6, wherein the outer door skin includes a retaining lip extending across a top edge of the outer door skin, the retaining lip retaining a top edge of the full glass inner panel.

21. The household cooking appliance of claim 1, wherein the outer door skin comprises:

an outer surface;

a first side surface and a second side surface opposed to the first side surface, the first side surface and the second side surface extending substantially perpendicular from side edges of the outer surface in a direction toward the inner glass panel; and an upper surface extending substantially perpendicular from an upper edge of the outer surface in the direction toward the inner glass panel, wherein the full glass inner panel forms the inner surface of the oven door, the full glass inner panel extending substantially from the first side surface to the second side surface.

22. The household cooking appliance of claim 1, wherein the inner surface includes a first portion and a second portion, the first portion being adjacent to a first area within the perimeter of the seal surrounding the opening and directly exposed to heating of the oven chamber, and the second portion being adjacent to a second area outside of the perimeter of the seal and being insulated from the heating of the oven chamber by the seal.

23. The household cooking appliance of claim 22, wherein the full glass inner panel extends substantially from edge-to-edge of the oven door.

24. The household cooking appliance of claim 22, wherein the full glass inner panel includes a transparent ceramic inner panel.

25. A household cooking appliance comprising:

a housing having an oven chamber accessible through an opening, the opening having a seal surrounding a perimeter of the opening; and an oven door covering the opening and moveable about a hinge between an open position and a closed position, the oven door including:

an outer door skin having an outer glass panel;

a full glass inner panel having an inner surface that abuts the seal when the oven door is in a closed position, the full glass inner panel closing an inner side of the outer door skin and the inner surface being exposed to the oven chamber when the oven door is in the closed position; and an integrated drip tray assembly that collects condensation from the inner surface of the full glass inner panel, the integrated drip tray assembly extending across a bottom edge of the full glass inner panel and restraining the bottom edge of the full glass inner panel for securing the full glass inner panel to the oven door, the integrated drip tray assembly being sealed to the full glass inner panel;

a hinge retainer coupling a hinge assembly of the oven door to the outer door skin, wherein the integrated drip tray assembly is integrally formed with the hinge retainer.

26. The household cooking appliance of claim 1, wherein the oven door further includes:

an outer glass panel mounting system that couples the outer glass panel to the outer door skin, the outer glass panel mounting system including a plurality of studs coupled to the outer door skin, and a plurality of brackets engaging the plurality of studs and supporting the outer glass panel between the plurality of brackets and the outer door skin.

* * * * *